US007812322B2

(12) United States Patent
Wagner et al.

(10) Patent No.: US 7,812,322 B2
(45) Date of Patent: Oct. 12, 2010

(54) RADIATION-SHIELDING ASSEMBLIES AND METHODS

(75) Inventors: Gary S. Wagner, Independence, KY (US); Elaine E. Haynes, St. Louis, MO (US); Yogesh P. Patel, North Bergen, NJ (US)

(73) Assignee: Mallinckrodt Inc., Hazelwood, MO (US)

( * ) Notice: Subject to any disclaimer, the term of this patent is extended or adjusted under 35 U.S.C. 154(b) by 185 days.

(21) Appl. No.: 11/995,732

(22) PCT Filed: Jul. 26, 2006

(86) PCT No.: PCT/US2006/029059

§ 371 (c)(1),
(2), (4) Date: Jan. 15, 2008

(87) PCT Pub. No.: WO2007/016174

PCT Pub. Date: Feb. 8, 2007

(65) Prior Publication Data

US 2008/0210891 A1 Sep. 4, 2008

(51) Int. Cl.
*G21F 5/015* (2006.01)

(52) U.S. Cl. ..... 250/432 R; 250/428; 250/505.1; 250/506.1; 250/507.1; 250/515.1

(58) Field of Classification Search ..... 250/428, 250/423 R, 433, 434, 435, 436, 432 RD, 250/505.1, 506.1, 507.1, 515.1
See application file for complete search history.

(56) References Cited

U.S. PATENT DOCUMENTS 2,915,640 A 4/1957 Grubel et al.
3,655,985 A * 4/1972 Brown et al. ..... 250/506.1
3,882,315 A 5/1975 Soldan
4,020,355 A 4/1977 Czaplinski et al.
4,081,688 A * 3/1978 Fries ..... 250/506.1
4,084,097 A * 4/1978 Czaplinski et al. ..... 250/506.1
4,092,546 A * 5/1978 Larrabee ..... 250/515.1
4,144,461 A * 3/1979 Glasser et al. ..... 250/506.1
4,270,052 A * 5/1981 King ..... 250/432 PD
4,506,155 A * 3/1985 Suzuki et al. ..... 250/252.1
4,788,438 A 11/1988 Evers
4,846,235 A * 7/1989 Handke ..... 141/311 R
4,923,088 A 5/1990 Tanaka et al.
5,042,679 A 8/1991 Crowson et al.

(Continued)

FOREIGN PATENT DOCUMENTS

WO WO 00/62305 10/2000

*Primary Examiner*—Bernard E Souw
*Assistant Examiner*—Michael J Logie

(57) ABSTRACT

The invention relates to the handling of radioactive material. For instance, a radiation shield of the invention may include a body having a cavity therein for receiving radioactive material. An opening to the cavity may be defined in the body. A base may be releasably attachable to the body (generally toward the opening) to at least partially enclose the radioactive material in the cavity. In the case that the radiation shield includes a plurality of interchangeable bases, one of the bases may have at least one of a shorter length and a lighter weight than another of the bases. The base(s) may be designed to enclose more than one size and/or shape of container in the cavity. The base(s) may include a hand grip to facilitate manual gripping of the radiation shield. The base(s) may include a guard to reduce exposure to radiation from manual handling of the radiation shield.

22 Claims, 16 Drawing Sheets

U.S. PATENT DOCUMENTS 5,274,239 A * 12/1993 Lane et al. ..... 250/370.01
5,397,902 A * 3/1995 Castner et al. ..... 250/432 PD
5,552,612 A 9/1996 Katayama et al.
5,672,883 A 9/1997 Reich
5,828,073 A * 10/1998 Zhu et al. ..... 250/506.1
5,834,788 A 11/1998 Fu et al.
RE36,693 E 5/2000 Reich
6,576,918 B1 * 6/2003 Fu et al. ..... 250/507.1
6,614,040 B1 * 9/2003 Zens ..... 250/515.1
6,822,253 B1 11/2004 Martin et al.
7,100,646 B2 * 9/2006 Py et al. ..... 141/329
7,726,357 B2 * 6/2010 Py et al. ..... 141/69
2005/0035310 A1 2/2005 Drobnik et al.
2005/0107698 A1 * 5/2005 Powers et al. ..... 600/436
2006/0086909 A1 * 4/2006 Schaber ..... 250/506.1

* cited by examiner

RADIATION-SHIELDING ASSEMBLIES AND METHODS

FIELD OF THE INVENTION

The present invention relates generally to radiation-shielding systems and, more particularly, to radiation-shielding systems used in the production of radioisotopes for nuclear medicine.

BACKGROUND

Nuclear medicine is a branch of medicine that uses radioactive materials (e.g., radioisotopes) for various research, diagnostic and therapeutic applications. Radiopharmacies produce various radiopharmaceuticals (i.e., radioactive pharmaceuticals) by combining one or more radioactive materials with other materials to adapt the radioactive materials for use in a particular medical procedure.

For example, radioisotope generators may be used to obtain a solution comprising a daughter radioisotope (e.g., Technetium-99m) from a parent radioisotope (e.g., Molybdenum-99) which produces the daughter radioisotope by radioactive decay. A radioisotope generator may include a column containing the parent radioisotope adsorbed on a carrier medium. The carrier medium (e.g., alumina) has a relatively higher affinity for the parent radioisotope than the daughter radioisotope. As the parent radioisotope decays, a quantity of the desired daughter radioisotope is produced. To obtain the desired daughter radioisotope, a suitable eluant (e.g., a sterile saline solution) can be passed through the column to elute the daughter radioisotope from the carrier. The resulting eluate contains the daughter radioisotope (e.g., in the form of a dissolved salt), which makes the eluate a useful material for preparation of radiopharmaceuticals. For example, the eluate may be used as the source of a radioisotope in a solution adapted for intravenous administration to a patient for any of a variety of diagnostic and/or therapeutic procedures.

In one method of obtaining a quantity of eluate from a generator, an evacuated container (e.g., an elution vial) may be connected to the generator at a tapping point. For example, a hollow needle on the generator can be used to pierce a septum of an evacuated container to establish fluid communication between the container and the generator column. The partial vacuum of the container can draw eluant from an eluant reservoir through the column and into the vial, thereby eluting the daughter radioisotope from the column. The container may be contained in an elution shield, which is a radiation-shielding device used to shield workers (e.g., radiopharmacists) from radiation emitted by the eluate after it is loaded in the container.

After the elution is complete, the eluate may be analyzed. For example, the activity of the eluate may be calibrated by transferring the container to a calibration system. Calibration may involve removing the container from the shielding assembly and placing it in the calibration system to measure the amount of radioactivity emitted by the eluate. A breakthrough test may be performed to confirm that the amount of the parent radioisotope in the eluate does not exceed acceptable tolerance levels. The breakthrough test may involve transfer of the container to a thin shielding cup (e.g., a cup that effectively shields radiation emitted by the daughter isotope but not higher-energy radiation emitted by the parent isotope) and measurement of the amount of radiation that penetrates the shielding of the cup.

After the calibration and breakthrough tests, the container may be transferred to a dispensing shield. The dispensing shield shields workers from radiation emitted by the eluate in the container while the eluate is transferred from the container into one or more other containers (e.g., syringes) that may be used to prepare, transport, and/or administer the radiopharmaceuticals. Typically, the dispensing process involves serial transfer of eluate to many different containers (e.g., off and on throughout the course of a day). The practice of using a different shielding device for dispensing than was used for elution stems from the fact that it is common industry practice to place the shielded container upside down on a work surface (e.g., tabletop surface) during the idle periods between dispensing of eluate to one container and the next. Prior art elution shields are generally not conducive for use as dispensing shields because, among other reasons, they may be unstable when inverted. For example, some elution shields have a heavy base that results in a relatively high center of gravity when the elution shield is upside down. Further, some elution shields have upper surfaces that are not adapted for resting on a flat work surface (e.g., upper surfaces with bumps that would make the elution shield unstable if it were placed upside down on a flat surface). Radiopharmacies have addressed this problem by maintaining a supply of elution shields and another supply of dispensing shields.

The same generator may be used to fill a number of elution containers before the radioisotopes in the column are spent. The volume of eluate needed at any time may vary depending on the number of prescriptions that need to be filled by the radiopharmacy and/or the remaining concentration of radioisotopes in the generator column. One way to vary the amount of eluate drawn from the column is to vary the volume of the evacuated container used to receive the eluate. For example, container volumes ranging from about 5 mL to about 30 mL are common and standard containers having volumes of 5 mL, 10 mL, or 20 mL are currently used in the industry. A container having a desired volume may be selected to facilitate dispensing of a corresponding amount of eluate from the generator column.

Unfortunately, the use of multiple different sizes of containers is associated with significant disadvantages. For example, a radiopharmacy may attempt to manipulate a conventional shielding device so that can be used with containers of various sizes. One solution that has been practiced is to keep a variety of different spacers on hand that may be inserted into shielding devices to temporarily occupy extra space in the radiation shielding devices when smaller containers are being used. Unfortunately, this adds complexity and increases the risk of confusion because the spacers can get mixed up, lost, broken, or used with the wrong container and may be considered inconvenient for use. For instance, some conventional spacers surround the sides of the containers in the shielding-devices, which is where labels may be attached to the containers. Accordingly, the spacers may mar the labels and/or contact adhesives used to attach the labels to the container resultantly causing the spacers to stick to the sides of the container or otherwise gum up the radiation-shielding device.

Another problem with conventional radiation-shielding systems is that dispensing shields may be somewhat inconvenient to handle. Whereas elution shields may be handled between one and ten times in a typical day, which limits the importance of the ergonomics of elution shields, a dispensing shield may be handled hundreds of times in a typical day. This makes the ergonomics of dispensing shields important. Prior art dispensing shields can be relatively heavy (e.g., 3-5 pounds) and have utilitarian designs focusing on radiation-shielding and function rather than ease of handling. For example, dispensing shields can be cylindrical, have sharp edges, and lack an obvious place for gripping them. Because of the repetitive handling of dispensing shields by workers, the aggregate toll of the foregoing inconveniences can add up to discomfort, injury, and other problems.

Further, each time a worker lifts a dispensing shield to transfer eluate from the container housed therein to other containers, the worker is exposed to radiation escaping the dispensing shield through the opening that is used to access the container. A worker can significantly reduce exposure to radiation in the dispensing process by gripping the dispensing shield at a place that is relatively farther from the opening rather than a place that is relatively closer to the opening. Unfortunately, prior art dispensing shields do little to discourage the practice of gripping the dispensing shield near the opening, putting the onus on the individual worker to be mindful of hand placement when handling a dispensing shield.

Thus, there is a need for improved radiation-shielding systems and methods of handling containers containing one or more radioisotopes that facilitate safer, more convenient, and/or more reliable handling of radioactive materials.

SUMMARY

One aspect of the invention is directed to a radiation-shielding system that is designed to facilitate safe handling of radioactive materials by providing flexibility and convenience in the manner in which radioactive materials are enclosed in protective radiation shielding. The system includes a structure (broadly characterized as a body) having a cavity therein for receiving the radioactive material. Two openings to the cavity are provided in the body, the first of which is sized smaller than the second. The system also includes a pair of bases constructed for releasable attachment to the body generally at the second (larger) opening. One of the bases is shorter in length and/or lighter in weight than the other.

Another aspect of the invention is a method of handling a radioisotope in a cavity formed in a radiation-shielding body. There are two openings into the cavity, one of which is sized smaller than the other. The container is inserted into the cavity through the larger opening and a loading base is releasably attached to the body generally at the larger opening to at least partially enclose the container in the cavity. The loading base is constructed to limit escape of radiation from the cavity through the larger of the two openings. The radioisotope is loaded into the container in the cavity through the smaller of the two openings while the loading base is attached to the body. The loading base is detached from the body. A dispensing base is releasably attached to the body generally at the larger of the two openings to at least partially enclose the container in the cavity. The dispensing base is constructed to limit escape of radiation from the cavity through the larger opening. The dispensing base has at least one of a shorter length and a lighter weight than the loading base. At least some of the radioisotope from the container is removed through the first opening to the cavity without removing the container from the cavity and while the dispensing base is attached to the body.

Another aspect of the invention is directed to a radiation-shielding assembly for convenient and safe dispensing of a radioactive material. The system includes a radiation-shielding body having a cavity therein for receiving the radioactive material. There is an opening into the cavity through the body. A hand grip is attached to the body and is constructed to facilitate grasping and holding of the body during movement thereof. The hand grip has a grip surface and a guard positioned between the grip surface and the opening into the cavity that may, in one regard, be said to discourage gripping of the assembly near the opening.

In another aspect, the invention is directed to a radiation-shielding assembly that provides flexibility to adapt the assembly to enclose containers of different shapes and/or sizes. The assembly has a body at least partially defining a cavity for holding the radioactive material. There is an opening into the cavity through the body. The body is constructed to limit escape of radiation from the cavity through the body. The assembly also includes a base constructed for releasable attachment to the body generally at the opening. The base is constructed to limit escape of radiation from the cavity through the opening when the base is attached to the body in a first orientation relative to the body and when the base is attached to the body in a second different orientation relative to the body. The base is constructed to position a first container at a predetermined location in the cavity when the base is attached to the body in the first orientation and to position a second container at a predetermined location in the cavity when the base is attached to the body in the second orientation. The first and second containers differ from one another in height and/or diameter.

Still another aspect of the invention is directed to a method of handling radioactive materials. The method includes placing a first container in a cavity in a radiation-shielding body. There is an opening to the cavity in the body. The first container has a first size and a first shape. A base is releasably attached to the body generally at the opening while the base is in a first orientation relative to the body. The base is configured to position the first container at a predetermined location in the cavity when the base is attached to the body in the first orientation. The base is detached from the body and the first container is removed from the cavity. A second container that has a different size and/or a different shape than the first container is placed in the cavity. The base is releasably attached to the body generally at the opening while the base is in a second orientation relative to the body different than the first orientation. The base is configured to position the second container at a predetermined location in the cavity when the base is attached to the body in the second orientation.

Yet another aspect of the invention is directed to a method of using a radiation-shielding assembly, such as one of the radiation-shielding assemblies described herein. With regard to this method, a first component of a radiation-shielding assembly is releasably attached to a second component of the radiation-shielding assembly while the first component is in a first orientation (relative to the second component) to define a cavity of a first size and first shape. Further, the first component can be releasably attached to the second component while the first component is in a second orientation different from the first orientation (relative to the second component) to define a cavity of at least one of a second size and a second shape different from the first size and the first shape, respectively.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the aspects of the present invention.

BRIEF DESCRIPTION OF THE FIGURES

Corresponding reference characters indicate corresponding parts throughout the figures.

DETAILED DESCRIPTION OF ILLUSTRATED EMBODIMENTS

Figure 1:
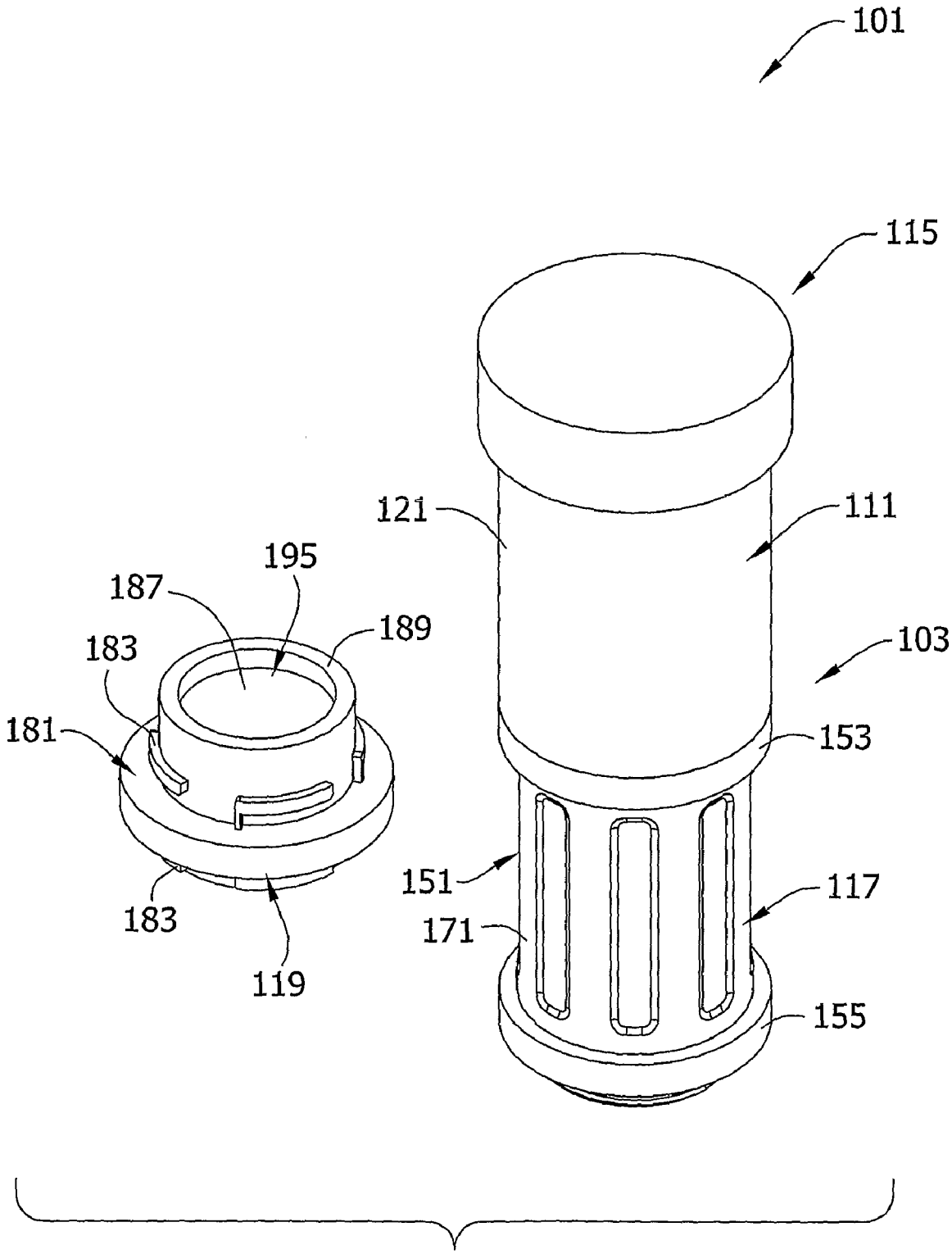
FIG. 1 is a perspective view of a radiation-shielding system of the present invention.

Referring now to the figures, and first to FIGS. 1-6 in particular, one embodiment of a radiation-shielding system of the present invention, generally designated 101, is shown as a rear-loaded elution and dispensing shield combination. The system 101 may enclose a container (e.g., elution and/or dispensing vial) containing a radioisotope (e.g., Technetium-99m) that emits radiation in a radiation-shielded cavity in the system, thereby limiting escape of radiation emitted by the radioisotope from the system. Thus, the system 101 may be used to limit the radiation exposure to handlers of one or more radioisotopes or other radioactive material. For example, parts of the system 101 may be assembled to form an elution shield 103 and other parts of the system may be assembled to form a dispensing shield 105, as discussed in more detail later herein.

The radiation-shielding system 101 includes a body 111 having a cavity 113 at least partially defined therein for receiving the radioactive material. The embodiment shown in the figures also includes a cap 115 and a pair of interchangeable bases 117, 119. The body 111, cap 115, and bases 117, 119 may be used to substantially enclose a container C1 (shown in phantom in FIGS. 3 and 4) in the cavity 113.

The body 111 may include a circumferential sidewall 121 that at least partially defines the cavity 113. The sidewall 121 of the body 111 shown in the figures is substantially tubular, but the sidewall can have other shapes (e.g., polygonal, tapered, etc.). The sidewall 121 may be adapted to limit escape of radiation from the cavity 113 through the sidewall. For example, in some embodiments, the sidewall 121 may include (e.g., be constructed of) one or more radiation-shielding materials (e.g., lead, tungsten, depleted uranium and/or another material). The radiation-shielding material can be in the form of one or more layers (not shown). Some or all of the radiation-shielding material can be in the form of a substrate impregnated with one or more radiation-shielding materials (e.g., a moldable tungsten-impregnated plastic). Those skilled in the art will know how to design the body 111 to include a sufficient amount of one or more selected radiation-shielding materials in view of the amount and kind of radiation expected to be emitted in the cavity 113 and the applicable tolerance for radiation exposure to limit the amount of radiation that escapes through the sidewall 121 to a desired level.

One end of the body 111 may have a first opening 127 to the cavity 113 and a second end of the body may have a second opening 129 to the cavity, as shown in FIGS. 3-6. The second opening 129 may be sized greater than the first opening 127. For example, the first opening 127 may be sized to prevent passage of one or more containers (e.g., containers C1 (FIGS. 3 and 4) and C2 (FIGS. 5 and 6) therethrough while permitting passage of the tip of a needle (not shown) that may be, for example, a needle on a tapping point of a radioisotope generator. As an example, the illustrated body 111 comprises an annular flange 131 extending radially inward from the sidewall 121 near the top of the sidewall. (As used herein the terms "top" and "bottom" are used in reference to the orientation of the system 101 in FIG. 3 but do not require any particular orientation of the system or its component parts).

The first opening 127, which in the illustrated embodiment is a substantially circular opening, may be defined by an inner edge of the flange 131. The flange 131 may have a chamfer 133 at the opening 127 to facilitate guiding the tip of a needle toward a pierceable septum (not shown) of a container received in the cavity. The inner surface of the body 139 adjacent the flange 131 may be stepped, tapered, or a combination thereof to help align the top of a container with the first opening 127 as the container is loaded into the cavity 113. The flange 131 may be integrally formed with the sidewall 121 or manufactured separately and secured thereto. The flange 131 may include a radiation-shielding material, as described above, to limit escape of radiation from the cavity. However, the flange 131 can be substantially transparent to radiation without departing from the scope of the invention. The second opening 129 is sized to permit passage of one or more containers (e.g., C1 and C2) therethrough for loading and unloading of the containers into and out of the cavity 113. For example, the second opening 129 may have about the same size, shape, and cross sectional area as the inside of the circumferential sidewall 121.

Figure 2:
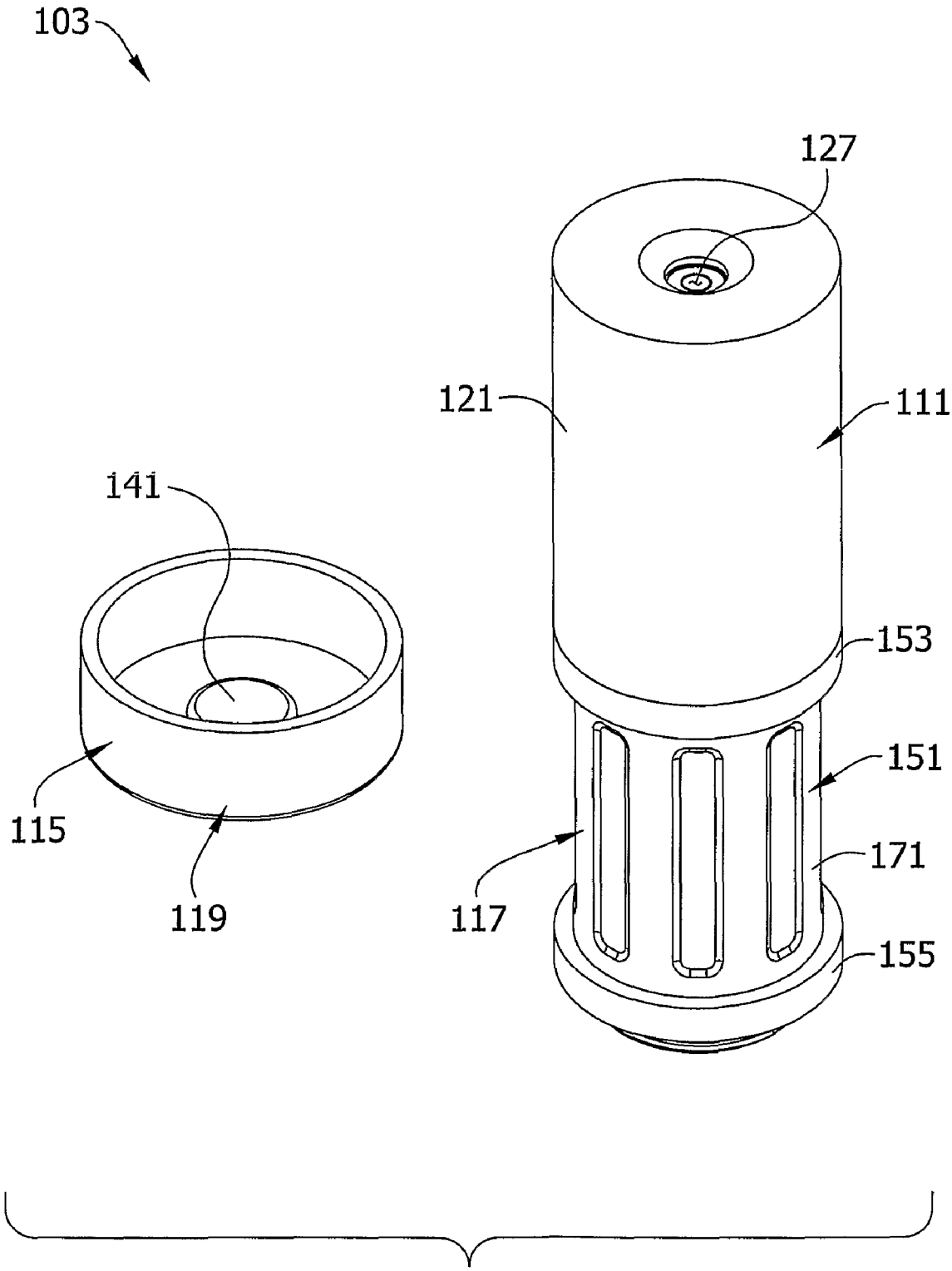
FIG. 2 is a perspective view of various components of the system of FIG. 1.

The cap 115 may be constructed for releasable engagement with the body 111 over the first opening 127 thereof. For example, the cap 115 may be constructed for releasable attachment to the body 111 or it may be designed for placement in contact with the body without any connection thereto. The cap 115 may be constructed in many different ways. As one example of a suitable cap construction, the cap 115 shown in FIGS. 3 and 5 comprises a magnetic portion 141 that attracts the body 111 (e.g., the flange 131) when the cap is placed over the end of the body to cover the first opening 127, thereby resisting movement of the cap away from the body. In some embodiments, the body 111 may be constructed of a material that is attracted by the magnetic portion 141 of the cap 115. In other embodiments, the body 111 may comprise a material having a relatively weaker attraction or no attraction to the magnetic portion 141 of the cap, and an attracting element (not shown) made of a material that has a relatively stronger attraction to the magnetic portion (e.g., iron or the like) molded into or otherwise secured to the body to enable the magnetic portion of the cap 115 to attract the body. Further, the cap and/or the body may be equipped with detents, threading snaps and/or friction fitting elements or other fasteners that are operable to releasably attach the cap to the body without the use of magnetism without departing from the scope of the invention. The cap may be removed from the body as shown in FIG. 2 to expose the first opening 127 and permit access to a container in the cavity 113 through the first opening.

The cap 115 may be constructed to limit escape of radiation emitted in the cavity 113 through the first opening 127 when the cap is placed on the body 111. For example, the cap 115 may comprise one or more radiation-absorbing materials, as described above, to achieve the desired level of protection against radiation. In order to reduce costs, radiation-absorbing materials may be positioned only at a center portion of the cap (e.g., in registration with the first opening when the cap is engaged with the body) while an annular outer portion surrounding the radiation-absorbing center portion may be made from less expensive and/or lighter-weight non-radiation-absorbing materials, but this is not required for practice of the invention.

Figure 3:
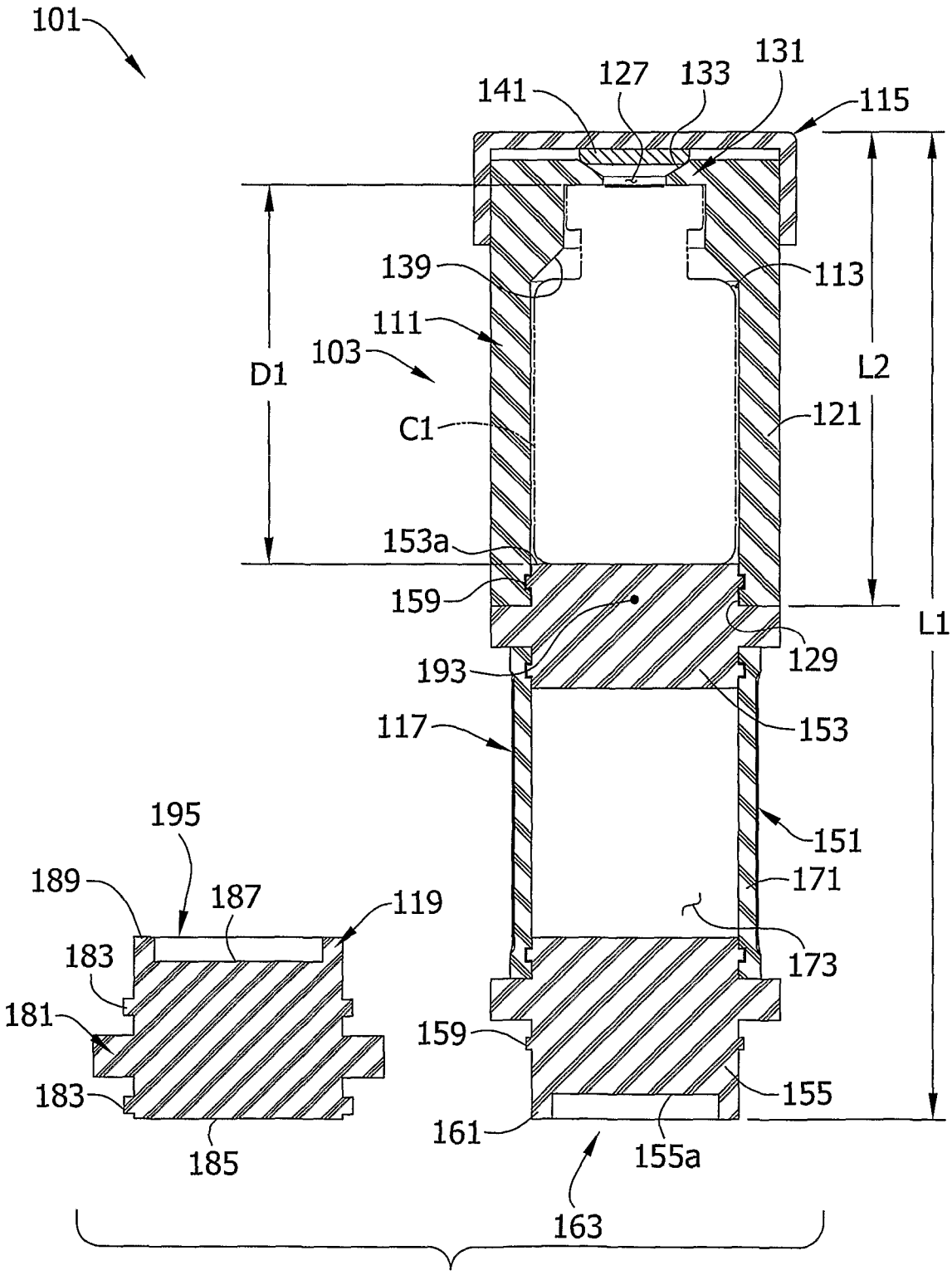
FIG. 3 is a cross section of the system of FIG. 1 configured to form an elution shield.

Referring to FIG. 3, the first base 117 may be constructed for releasable attachment to the body 111 (e.g., as a closure for the second opening 129) to enclose a container C1 in the cavity 113 during a process (e.g., an elution process) in which radioactive material is loaded into the container. Hence, the first base may otherwise be referred to as a "loading base," although use of that term does not imply that the system is limited to use in elution or other loading processes when the first base is attached to the body. Similarly, the assembly 103 formed by attachment of the loading base 117 to the body, may otherwise be referred to as an "elution shield," although use of that term does not limit the assembly to use in an elution or other loading process.

As seen in FIGS. 3-6, the illustrated loading base 117 comprises an extension element 151 having radiation shields 153, 155 secured at opposite ends thereof. The radiation shields 153, 155 may be permanently attached to the extension element 151, as shown in the figures, or releasably attached to the extension element (e.g., by threaded or other suitable releasable connections). The extension element 151 shown in the figures is a generally tubular structure and may be constructed of one or more relatively inexpensive, lightweight, durable materials, such as high-impact polycarbonate materials (e.g., Lexan®), nylon, and/or the like. The loading base 117, or a portion thereof (e.g., the extension element 151), may be coated with a grip enhancing coating (not shown). For example, the loading base 117 may be coated with a thermoplastic elastomer (e.g., Santoprene®, which is commercially available from Advanced Elastomer Systems, LP of Akron, Ohio) to facilitate manual gripping of the loading base. The extension element can have other shapes (e.g., polygonal, tapered, and the like) without departing from the scope of the invention. Likewise, the extension element can be constructed of other materials without departing from the scope of the invention.

The loading base 117 may be constructed for releasable attachment to the body 111 in a first orientation (FIG. 3) to accommodate a first container C1 in the cavity 113 and also constructed for releasable attachment to the body in a second orientation (FIG. 5) to accommodate a second container C2 in the cavity having a different size than the first container C1. For example, the loading base 117 may comprise one or more connectors 159 (e.g., threads, bayonet connection lugs, or the like) that are operable to releasably attach the loading base to the body 111 when the loading base has a first orientation relative to the body and to releasably attach the loading base to the body when the base has a second orientation relative to the body (e.g., an orientation in which the loading base has been rotated about 180 degrees from the first orientation).

Figure 5:
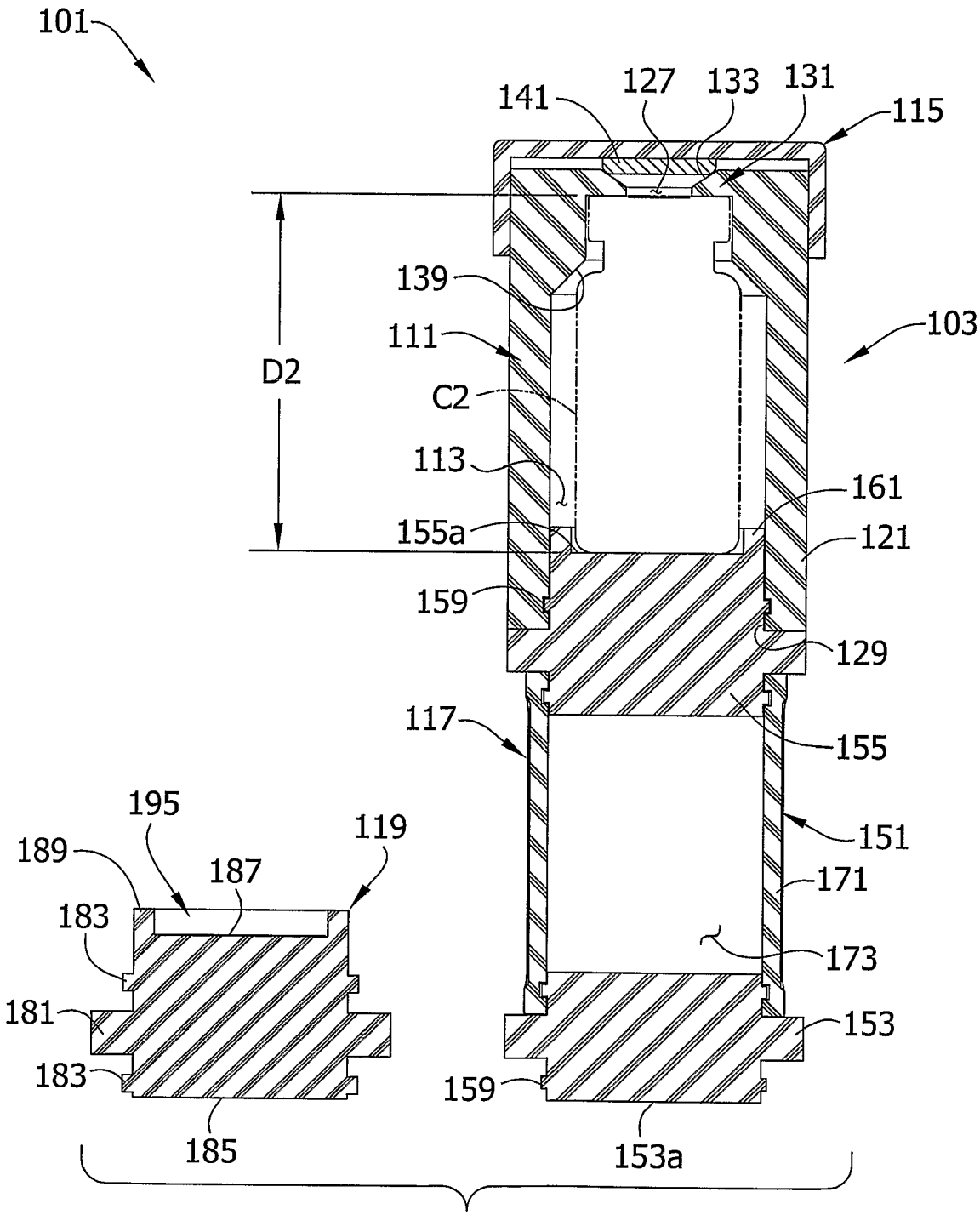
FIG. 5 is a cross section similar to FIG. 3 with the system configured to form an elution shield and further configured to shield a smaller container.

As shown in FIGS. 3 and 5, one of the radiation shields 153 may be positioned generally at the second opening 129 when the loading base 117 is attached to the body 111 in its first orientation (FIG. 3) and the other radiation shield 155 may be positioned generally at the second opening when the loading base is attached to the body in its second orientation (FIG. 5). Further, the radiation shields 153, 155 may each comprise a closure surface 153*a*, 155*a* that is positioned generally at the second opening 129 and faces inward of the cavity 113 when the loading base is attached to the body 111 so the corresponding radiation shield is positioned generally at the second opening. The closure surface 155*a* for one of the radiation shields 155 may be designed to extend farther into the opening 229 than the closure surface 153*a* for the other radiation shield 153 so that the size and/or shape of the cavity 113 can be controllably varied by selectively attaching the loading base 117 to the body 111 in either of its first or second orientations.

When the loading base 117 of the embodiment shown in the figures is attached to the body 111 in the orientation shown in FIG. 3, the distance D1 between the closure surface 153*a* and the first opening 127 is greater than the distance D2 between the other closure surface 155*a* and the first opening when the loading base is attached to the body in the orientation shown in FIG. 5. This may facilitate use of the system 101 with containers C1, C2 having different heights. For instance, by attaching the loading base 117 to the body 111 so a selected one of the radiation shields 153, 155 is positioned generally at the second opening 129, it is possible to position containers having different heights so they are in a predetermined location relative to the first opening (e.g., adjacent the first opening, in contact with or in close proximity to the flange 131, etc.), which may facilitate connection of the containers to a radioisotope generator.

Figure 4:
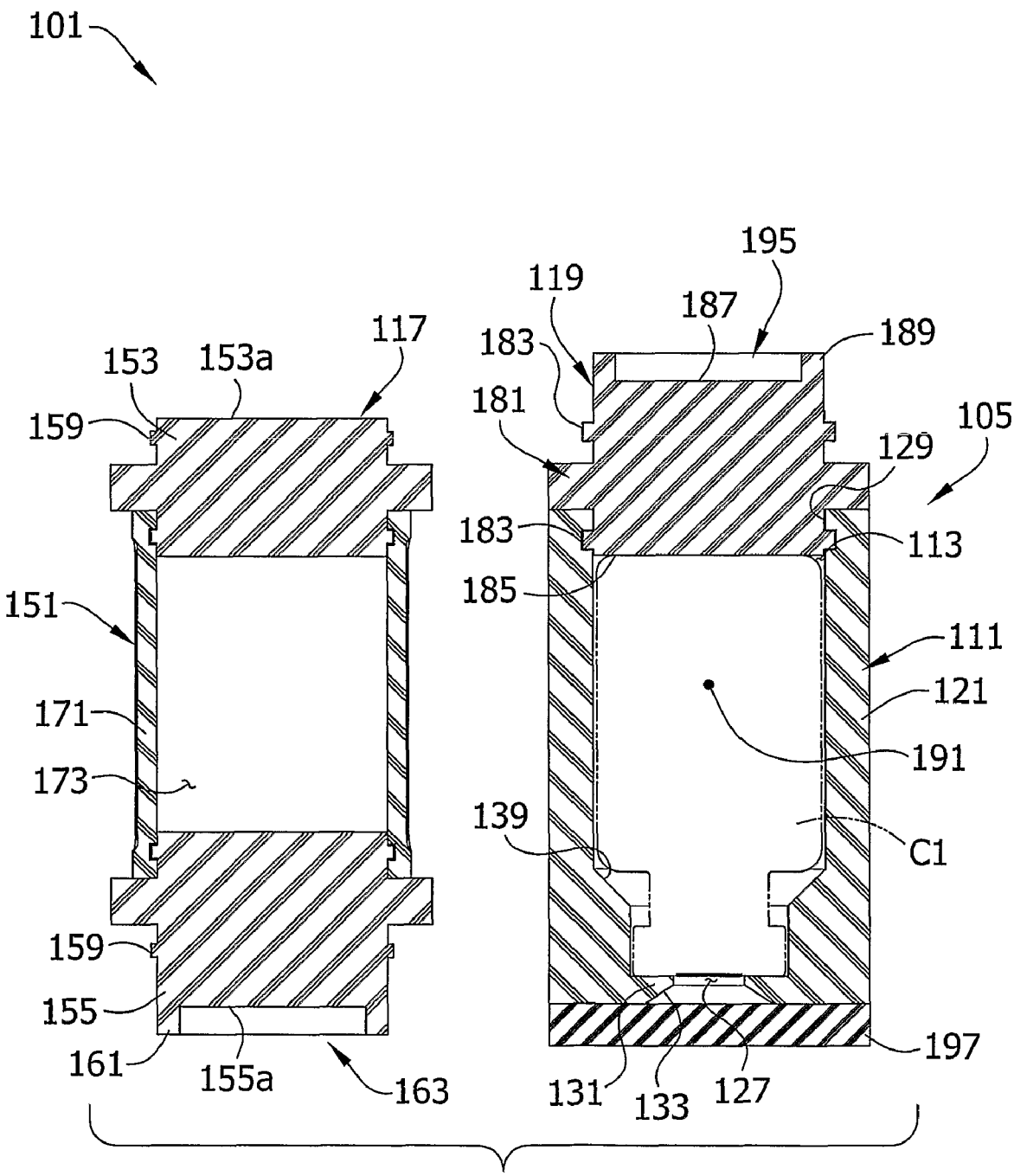
FIG. 4 is a cross section similar to FIG. 3 but with the system configured to form a dispensing shield.

Likewise, the loading base 117 may be configured such that in a first orientation of the base the cavity accommodates a first container having a first diameter and in a second orientation the cavity accommodates a second container having a second diameter different than the first diameter. For example, one of the radiation shields 155 of the embodiment shown in FIGS. 3-6 has a sidewall 161 configured to extend into the second opening 229 when the loading base 117 is attached to the body in its second orientation. The inner surface of the sidewall 161 has a reduced cross sectional area relative to the second opening 229. Thus, the closure surface 155*a* of the radiation shield 155 may be characterized as forming a cup-shaped structure 163 sized to receive the bottom end of the container C2 as shown in FIG. 4. The cup-shaped structure 163 may be adapted to hold the container C2 in a predetermined location within the cavity (e.g., so the bottom of the container is aligned with the first opening 127), which may facilitate piercing of a septum (not shown) on the container by the tip of a needle inserted through the first opening.

In contrast, the closure surface 153*a* of the other radiation shield 153 may be configured as a substantially flat surface that is substantially coextensive with the cross sectional area of the cavity 113. As shown in FIG. 3, the sidewall 121 of the body 111 can be used to position a larger diameter container C1 in a predetermined location in the cavity 113 (e.g., so the bottom of the container is aligned with the first opening 127). In other embodiments, each of the radiation shields could be designed to include a cup-shaped structure (of the same or different diameters) without departing from the scope of the invention. The system can be designed to hold two different containers in the same predetermined position or in different predetermined positions. Although the system shown in the figures is designed so that the smaller diameter container is also the shorter container, the system could also be designed so that the taller container is smaller in diameter without departing from the scope of the invention. Similarly, the system can be adapted to accommodate different sized containers that are identical in height and vary only in diameter, or vice-versa, without departing from the scope of the invention. Moreover, the closure surfaces can be distinct from the radiation shields without departing from the scope of the invention.

The loading base 117 may be adapted to limit escape of radiation from the cavity 113 through the second opening 129 when the loading base is attached to the body 111 in its first orientation, in its second orientation, and/or more suitably in both orientations. For example, the radiation shields 153, 155 may comprise one or more radiation-absorbing materials (as described above) so that the first radiation shield 153 limits escape of radiation through the second opening 129 when the loading base 117 is attached to the body 111 in the first orientation and so that the second radiation shield 155 limits escape of radiation through the second opening when the loading base is attached to the body in the second orientation. The radiation shields 153, 155 may be adapted to absorb and/or reflect radiation over an area that is substantially coextensive with the second opening 129. For example, the radiation shields 153, 155 may be configured to have substantially the same cross sectional shape and size as the second opening 129 and have the connectors 159 formed thereon so that the radiation shields can be releasably attached to the body 111 to plug the second opening with radiation-absorbing material. In other embodiments of the invention, however, the radiation shields may comprise radiation-shielding materials positioned to substantially cover the second opening 129 without being received therein. Those skilled in the art will know how to design the loading base 117 to include a sufficient amount of one or more radiation-absorbing materials in appropriate locations to limit escape of radiation through the second opening 129 to a desired level.

Referring to FIG. 3, the loading base 117 may be used to increase the overall length of the system 101 relative to the length of the body. For example, the extension element 151 of the loading base 117 may comprise a circumferential sidewall 171 generally corresponding to the circumferential sidewall 121 of the body 111. As those skilled in the art know, some radioisotope generators are designed to work with a shielding assembly having a particular minimum length (e.g., six inches). The loading base 117 may be assembled with a body 111 that would otherwise be too short for a particular radioisotope generator to satisfy the minimum length requirement of that generator. The extension element 151 may be transparent to radiation because other parts of the system 101 (e.g., the radiation shields 153, 155) can achieve the desired level of radiation shielding. Use of a relatively lighter-weight (e.g., non-radiation-absorbing) extension element 151 to provide the required length allows the weight of the elution shield 103 to be lighter and/or less expensive compared to a similar assembly that is constructed of relatively heavier-weight and/or more expensive materials (e.g., radiation-absorbing materials) along the entirety of the minimum length required by the particular radioisotope generator. There may be a void 173 in the loading base 117 for additional weight reduction.

Figure 6:
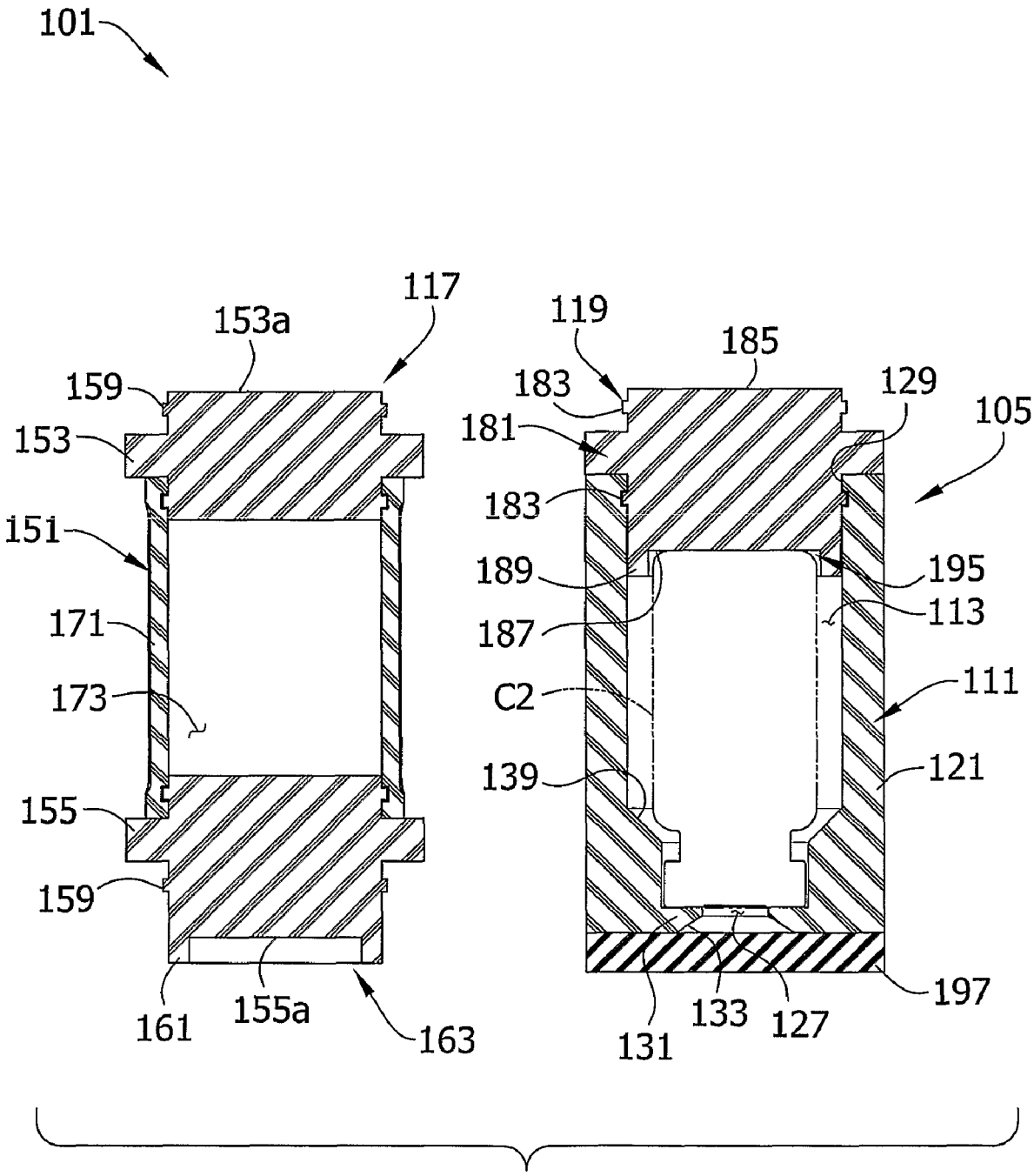
FIG. 6 is a cross section similar to FIG. 4 with the system configured to form a dispensing shield and further configured to shield a smaller container.
Figure 7:
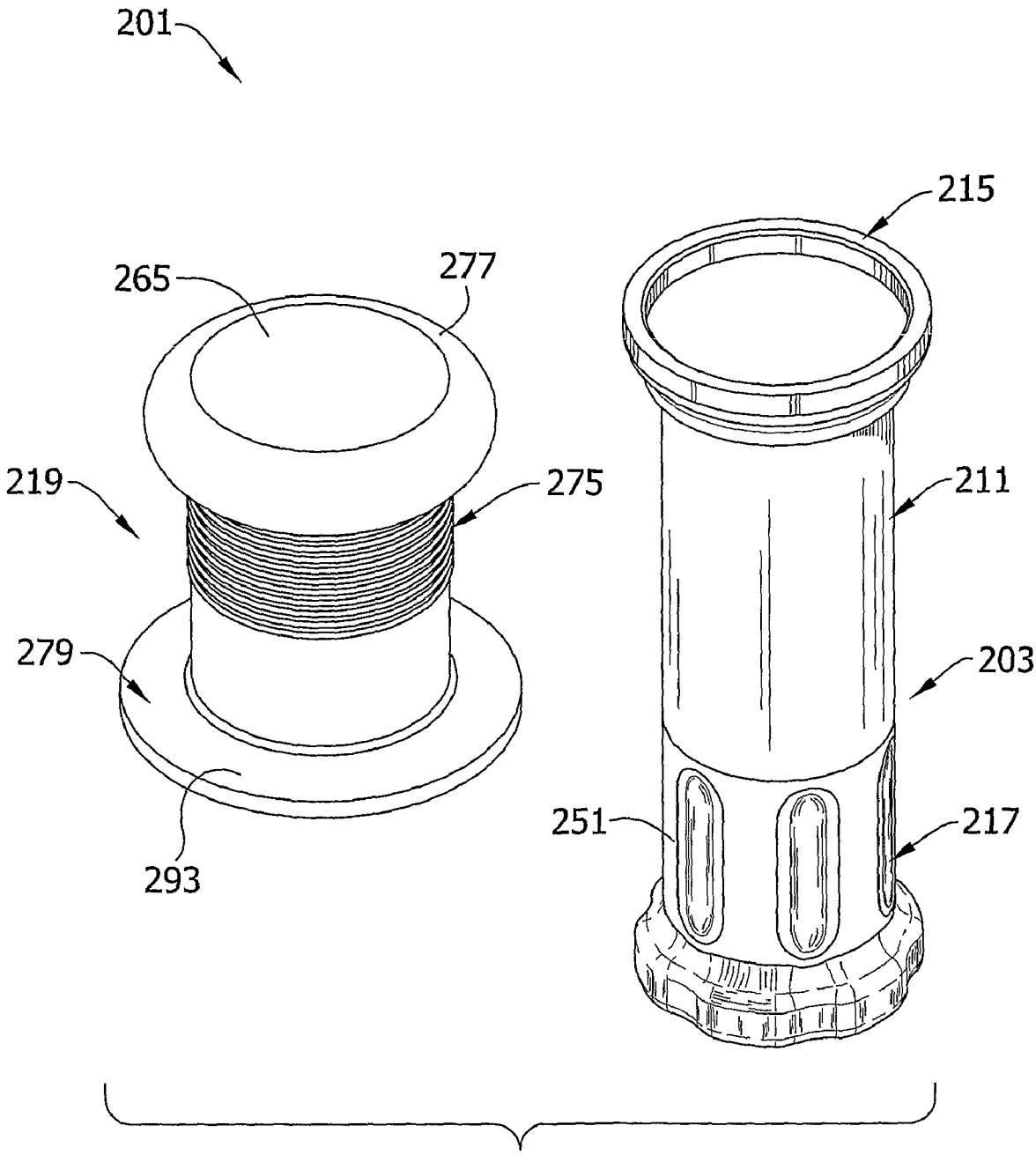
FIG. 7 is a perspective view of a second embodiment of a radiation-shielding system of the present invention.
Figure 8:
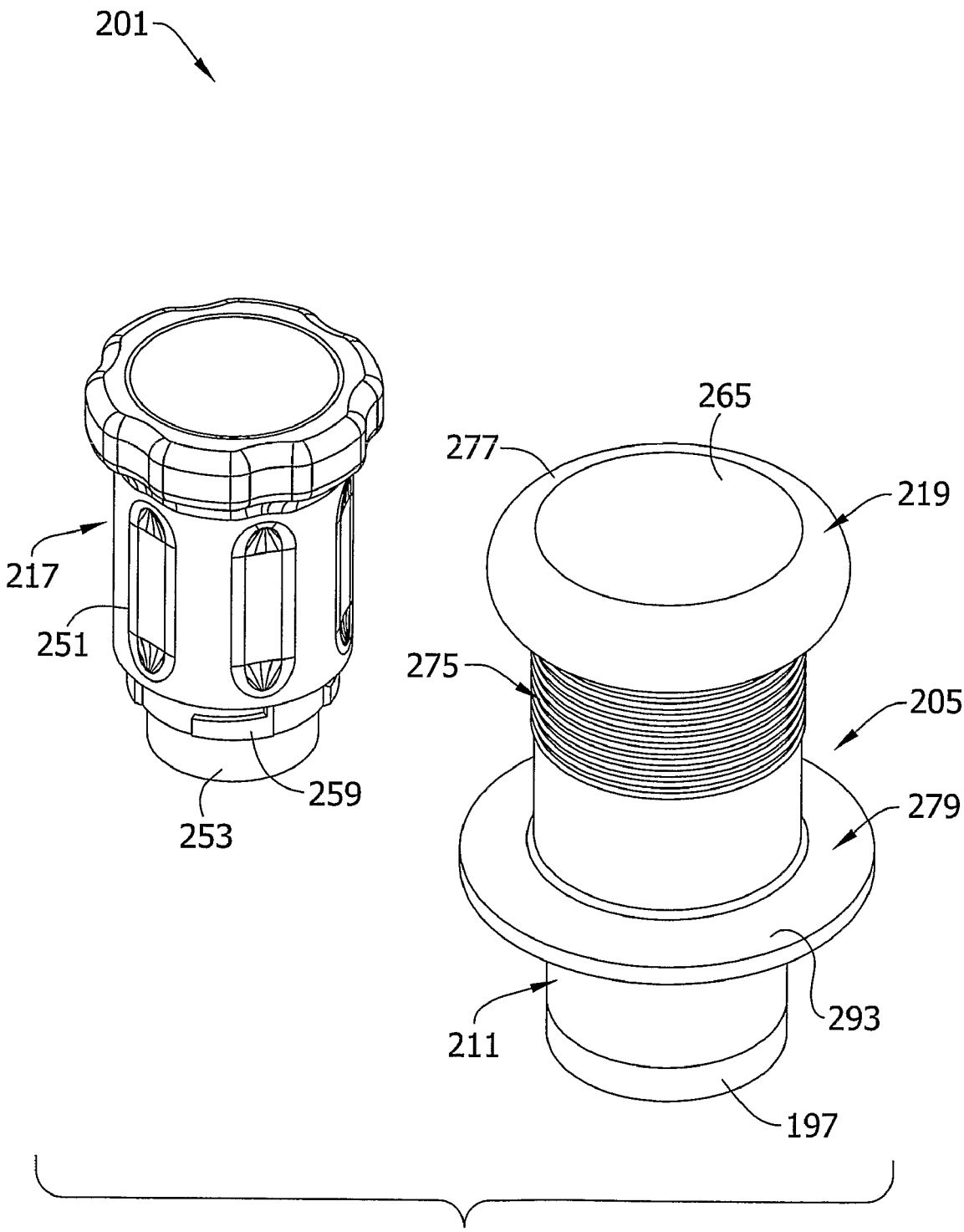
FIG. 8 is a perspective view of various components of the system of FIG. 7 with the components configured to form a dispensing shield.

Referring to FIGS. 4 and 6, the second base 119 may be constructed for releasable attachment to the body 111 to enclose a container in the cavity 113 thereof during a dispensing process. Hence, the second base 119 may otherwise be referred to as a "dispensing base," although use of that term does not imply that the system is limited to use in dispensing processes when the second base is attached to the body. Similarly, the assembly 105 formed by attachment of the dispensing base 119 to the body 111, may otherwise be referred to as a "dispensing shield," although use of that term does not limit the assembly to use in an dispensing or other process.

The dispensing base 119 shown in the figures, for example, comprises a single radiation shield 181 that acts as a closure for the second opening 129 of the body 111 when the dispensing base is attached to the body. The dispensing base 119 is constructed for selective releasable attachment to the body 111 in a first orientation in which the dispensing shield 105 accommodates a first container C1 (FIG. 4) and also constructed for releasable attachment to the body in a second orientation in which the dispensing shield 105 accommodates a second container C2 (FIG. 6) that has a different size and/or shape than the first container. Referring to FIGS. 4 and 6, for example, the dispensing base 119 may comprise connectors 183 (e.g., threads, bayonet connection lugs, or the like) that are operable to releasably attach the dispensing base to the body 111 when the dispensing base is in a first orientation relative to the body (FIG. 4) and to releasably attach the dispensing base to the body when the dispensing base is in a second orientation relative to the body (FIG. 6) that is different from (e.g., rotated about 180 degrees) from the first orientation.

Further, when the dispensing base 119 is attached to the body 111 in the first orientation, a first closure surface 185 may be positioned generally at the second opening 129 and face inward of the cavity 113. When the dispensing base is attached to the body in the second orientation, a second closure surface 187 may be positioned generally at the second opening and face inward of the cavity. The closure surfaces 185, 187 of the dispensing base 119 shown in the figures are structurally analogous to the corresponding closure surfaces 153*a*, 155*a* of the loading base 117 so that the dispensing base can be adapted to accommodate different containers in the same way as the loading base. Thus, the closure surfaces 185, 187 may be configured to extend different distances into the second opening 129, thereby allowing selective variation of the distance between the respective closure surface 185, 187 and the first opening 127 in the same manner described for the loading base 117.

A sidewall 189 extends above and around the circumference of one of the closure surfaces 187, thereby forming a cup-shaped structure 195 analogous to the cup-shaped structure 163 described for the loading base 117. The cup-shaped structure 195 may be used to position a container C2 at a predetermined location in the cavity 113 (e.g., so the bottom of the container is aligned with the first opening) in the same manner described for the loading base. Although the closure surfaces 153*a*, 155*a*, 185, 187 of the embodiment shown in the figures are similar in size and shape, it is also possible that the closure surfaces of the dispensing base may differ in size and/or shape from the corresponding closure surfaces of the loading base without departing from the scope of the invention.

The dispensing base 119 may be substantially shorter and lighter than the loading base 117. For instance, the dispensing base 119 may lack structure that is analogous to the extension element 151 of the loading base 117 because the need to satisfy the minimum length requirement of a radioisotope generator may only apply when the radioisotope generator is being used. Omission of an extension element makes the dispensing base 119 shorter and lighter. Likewise, the use of the single radiation shield 181 in the dispensing base 119 also reduces the length and weight of the dispensing base relative to the loading base 117, which has two radiation shields 153, 155. The combined center of gravity 191 of the dispensing shield 105 (FIG. 4) is closer to the first opening 127 than the combined center of gravity 193 of the elution shield 103 (FIG. 5). This may tend to make the dispensing shield 105 more stable when placed upside down on a flat surface (as shown in FIGS. 4 and 6) than the elution shield 103 would be if it were placed upside down on the same surface.

The radiation shielding system 101 may be used to provide radiation shielding for containers used to hold a radioisotope. For example, a container C1 (e.g., an evacuated elution vial) can be loaded into the cavity 113 through the second opening 129 in the body 111. After the container C1 is in the cavity 113, the loading base 117 may be attached to the body 111 as shown in FIG. 3 to form the elution shield 103 and substantially enclose the container in the cavity. The closure surface 153*a* and sidewall 121 of the body 111 position the container in a predetermined location in the cavity, which in the illustrated embodiment is approximately in contact with the flange 131 and in alignment with the first opening 127. The cap 115 may be removed (if present) to expose the first opening 127. Then, the container C1 may be connected to a radioisotope generator through the now exposed first opening 127 (e.g., by inserting the tip of a needle associated with a tapping point on the radioisotope generator into the container through the first opening). The container C1 is at least partially filled with an eluate comprising a radioisotope (e.g., Technetium-99m) produced by the generator. When a desired amount of eluate has been loaded into the container C1, the container may be disconnected from the radioisotope generator and the cap 115 replaced over the first opening to limit escape of radiation through the first opening.

The container C1 may be transported in the cavity 113 to another location where the eluate is analyzed (e.g., where its activity is calibrated and a breakthrough test is performed). The loading base 117 may be detached from the body 111 to allow the container C1 to be removed from the cavity 113 through the second opening 129 for the analysis. After the eluate has been analyzed, the container C1 can be reloaded in the cavity 113 through the second opening 129. The dispensing base 119 may be attached to the body 111, as shown in FIG. 4, in place of the loading base 117 to form the dispensing shield 105 and re-enclose the container C1 in the cavity 113. The dispensing shield 105 may be inverted and placed first opening 127 down on a work surface 197 (e.g., a radiation-absorbing coaster).

When a worker (e.g., a radiopharmacist) is ready to dispense some of the eluate from the container C1 to another container (e.g., syringe), he or she may lift the body 111 off the work surface 197, thereby exposing the first opening 127. The worker may dispense some or all of the eluate from the container C1 through the now exposed first opening 127. For example, the worker may pierce a septum (not shown) of the container C1 by inserting the tip of a needle attached to a syringe through the first opening 127 and drawing some or all of the eluate out of the container using the syringe. When a desired amount of the eluate has been dispensed from the container C1, the dispensing shield 105 may be replaced on the work surface 197 until more of the eluate is needed. When the container C1 is emptied of eluate or the eluate is no longer desired, the dispensing base 119 can be detached from the body 111 and the container C1 removed from the cavity 113 through the second opening 129.

The second smaller container C2 may then be loaded into the cavity 113 through the second opening 129. The loading base 117 may be attached to the body as shown in FIG. 5 so the closure surface 155*a* and sidewall 161 position the container in a predetermined location, which in the illustrated embodiment is in contact with the flange 131 and in alignment with the first opening 127. Then the elution process can be repeated as described above, resulting in a desired amount of eluate being loaded into the container C2. After the elution process the container C2 may be transported in the cavity 113 to another location as described previously for the first container C1. The loading base 117 may be detached from the body 111 to allow the container C2 to be removed from the cavity 113 through the second opening 129 for the analysis. After the analysis is complete, the container C2 may be replaced in the cavity 113 through the second opening 129. Then the dispensing base 119 may be attached to the body, as shown in FIG. 6, in place of the loading base 117. The eluate may be dispensed from the container C2 in substantially the same manner described for the first container C1.

Referring now to FIGS. 7-12E, another embodiment of a radiation-shielding system of the present invention, generally designated 201, is shown as a rear-loaded elution and dispensing shield combination. Like the radiation-shielding system 101 described above, the system 201 may enclose a container (e.g., elution and/or dispensing vial) containing a radioisotope (e.g., Technetium-99m) that emits radiation in a radiation-shielded cavity, thereby limiting escape of radiation emitted by the radioisotope from the system. Thus, the system may be used to limit the radiation exposure to handlers of one or more radioisotopes or other radioactive material.

The radiation-shielding system 201 has a body 211 having a cavity 213 at least partially defined therein for receiving the radioactive material. The radiation-shielding system shown in FIG. 7 also includes a cap 215 and a pair of interchangeable bases 217, 219. The body 211, cap 215, and bases 217, 219 may be used to substantially enclose a container C1 (shown in phantom in FIG. 9) in the cavity 213, as is described in more detail below. The body 211 and cap 215 of the system shown in the figures may be substantially analogous to the body 111 and cap 115 of the system 101 shown in FIGS. 1-6. For example, the body 211 may have first and second openings 227, 229 that are analogous to the first and second openings 127, 129 of the body 111 shown in FIGS. 3-6.

Figure 9:
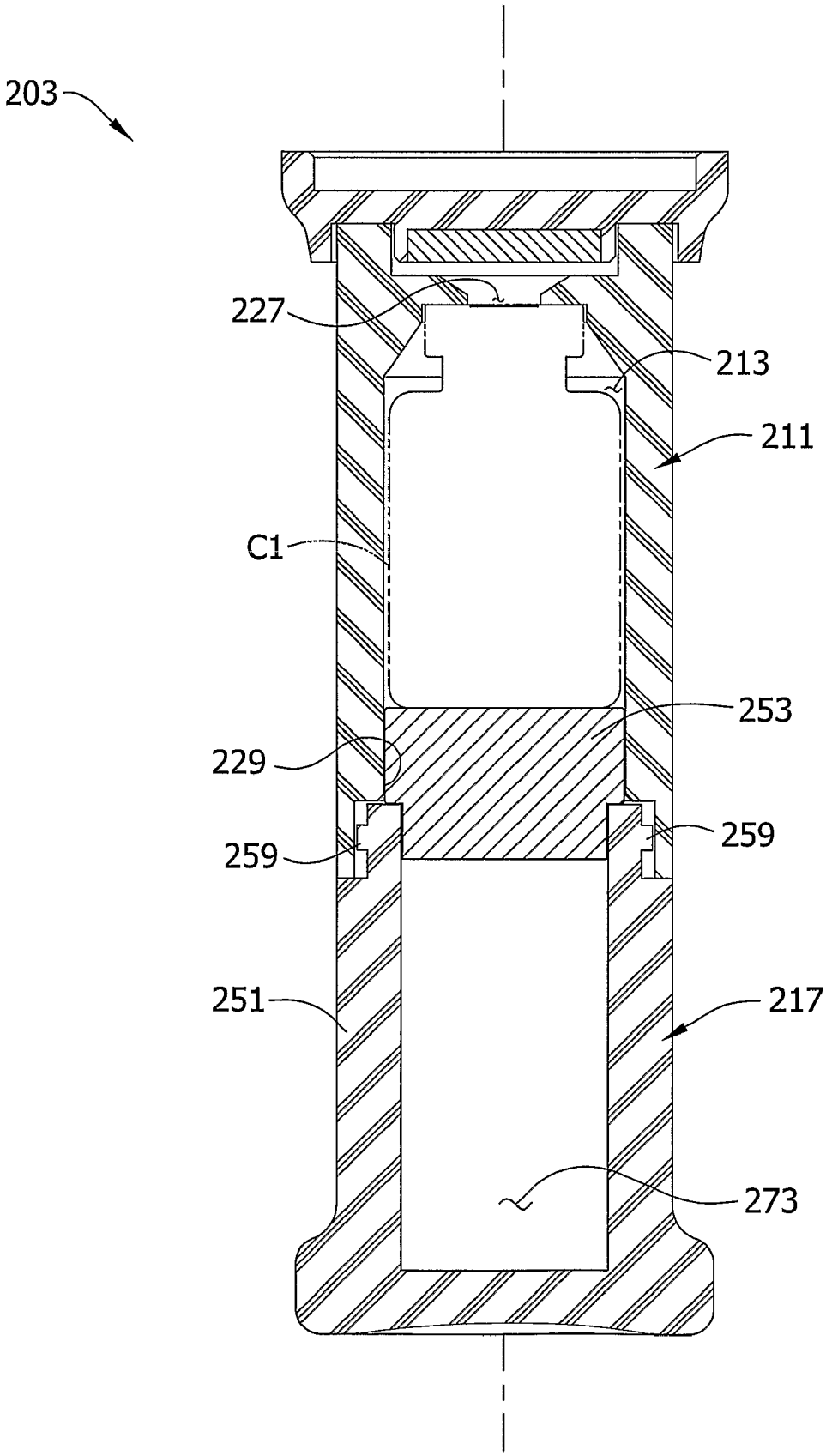
FIG. 9 is a cross section of various components of the system of FIG. 7 with the components configured to form an elution shield.

The system 201 shown in the figures includes a loading base 217 constructed for releasable attachment to the body 211 generally at the second opening 229 to form an elution shield 203. The loading base 217 shown in the figures (e.g., FIG. 9), for example, comprises connectors 259 (e.g., threads, bayonet connection lugs, or the like) that are operable to releasably attach the loading base to the body 211. The loading base 217 may be operable to limit escape of radiation from the cavity 213 through the second opening 229 when attached to the body 211. With reference to FIG. 9, the loading base 217 may comprise a tubular structure 251 having a radiation shield 253, which may comprises one or more radiation-absorbing materials as described previously, secured at one end so that the radiation shield is positioned generally at the second opening 229 when the loading base 217 is attached to the body 211. The other end of the tubular structure 251 may be closed (as shown in FIG. 9) or open (not shown). The tubular structure 251 may be constructed of a lightweight material (e.g., high-impact plastic) that is substantially transparent to radiation. The loading base may have a void 273 therein to reduce weight of the elution shield 203. The loading base 217, or a portion thereof (e.g., the tubular structure 251), may be coated with a grip enhancing coating (not shown) to facilitate manual gripping of the loading base. For instance, a thermoplastic elastomer (e.g., Santoprene®) is one example of a suitable grip enhancing coating material.

The loading base 217 may be operable in combination with the body 211 to provide an elution shield 203 having enough length to satisfy a minimum length requirement for a particular radioisotope generator, in the same manner described above in connection with the loading base 117 of system 101. It will be understood by those skilled in the art that the design of the loading base 217 can be varied substantially without departing from the scope of the invention. Although the system 201 shown in FIG. 7 has a different loading base than was described in connection with system 101, it is understood that the system 201 can be modified to use the same loading base 117 as the system 101 described previously without departing from the scope of the invention. Likewise, the system 201 can be modified to use a loading base having virtually any size and shape without departing from the scope of the invention.

Figure 10:
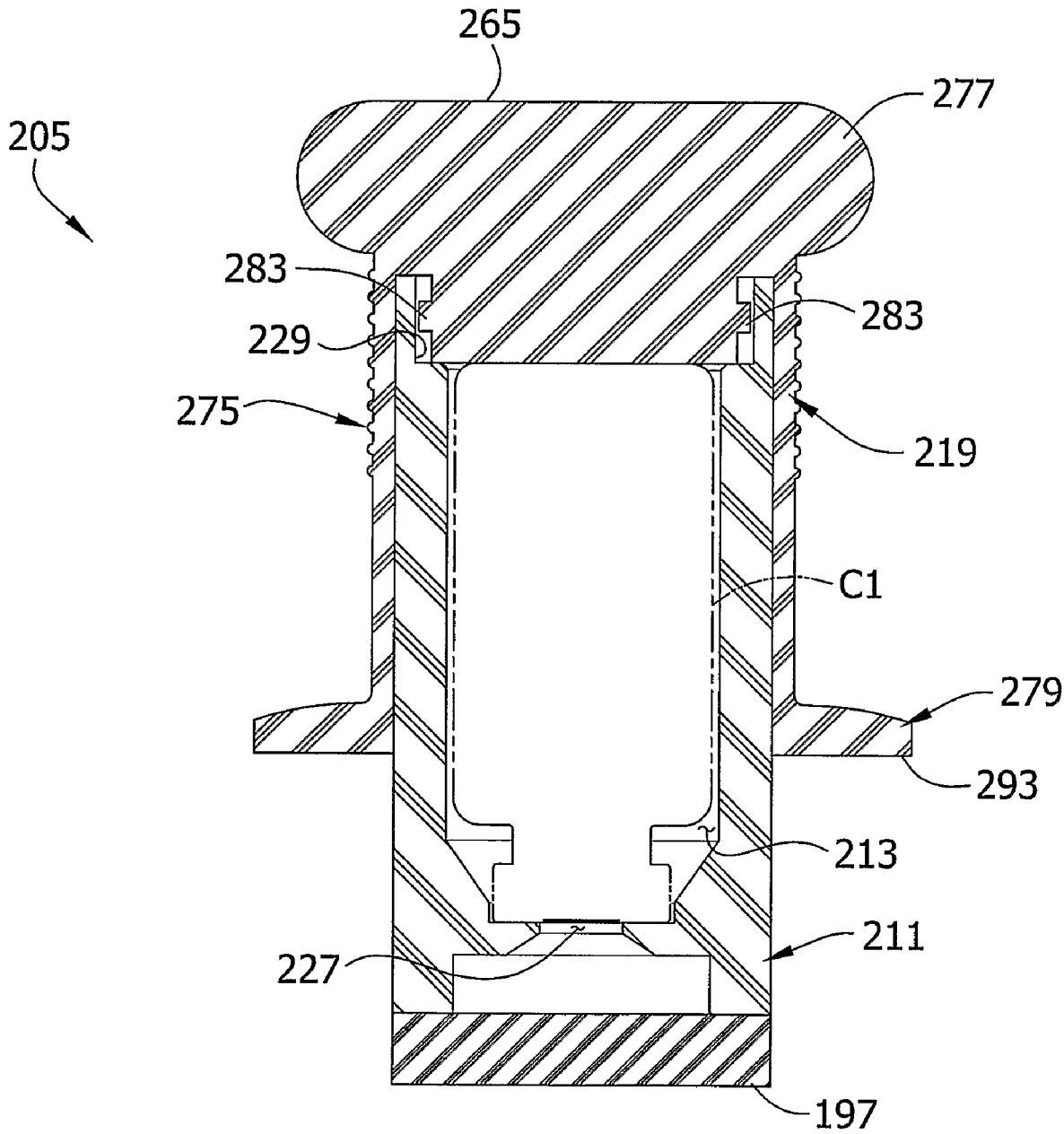
FIG. 10 is a cross section of the dispensing shield shown in FIG. 8.

Referring now to FIG. 10, the system 201 further comprises an ergonomic dispensing base 219 that is constructed for releasable attachment to the body 211 generally at the second opening 229 to form a dispensing shield 205. For example, the dispensing base 219 may generally be constructed in the form of a sheath adapted to receive at least the bottom portion of the body 211 therein, in which case the body 211 is partially sheathed by the dispensing base when the base 219 and body 211 are assembled to form the dispensing shield 205. The dispensing base 219 may have a closed end 265 and may comprise any suitable connectors (e.g., threads, bayonet connection lugs, or the like) for releasably attaching the dispensing base to the body 211. For example, in the embodiment shown in the figures, the dispensing base 219 comprises bayonet connection lugs 283 for releasably attaching the dispensing base to the body 211 using a bayonet connection (e.g., the same bayonet connection used to releasably attach the loading base 217 to the body 211).

The dispensing base 219 may be adapted to limit escape of radiation from the cavity 213 through the second opening 229 when it is attached to the body 211. For example, the dispensing base 219 may comprise one or more radiation-absorbing materials, as described above. Again, those skilled in the art will know how to provide a sufficient amount of radiation-absorbing materials in the dispensing base 219 to achieve a desired level of protection against radiation exposure. The dispensing base 219 may be designed with a concentration of radiation-absorbing materials positioned generally at the second opening 229 (not shown) when the dispensing base is attached to the body. In some embodiments, the entire dispensing base may be constructed of radiation-shielding materials (e.g., metal or tungsten-impregnated plastic).

The dispensing base 219 comprises a hand grip 275 that is adapted to fit comfortably in the palm of a person's hand. The hand grip 275 may comprise one or more types of grip enhancing features (e.g., grooves 275*a* (FIG. 12A), raised bumps 275*b* (FIG. 12B), finger indentations 275*c* (FIG. 12C), flats 275*d* (FIG. 12D), raised ridges 275*e* (FIG. 12E), combinations thereof, and the like) to improve the ability of a person to grip the dispensing base 219 by the hand grip. A grip enhancing coating (not shown) may be applied to the dispensing base 219, or a portion thereof (e.g., the hand grip 275), to facilitate manual gripping of the dispensing base. A thermoplastic elastomer (e.g., Santoprene®) is one example of a suitable grip enhancing coating material. A knob 277 may be formed at one end of the hand grip 275 (e.g., at the closed end 265 of the dispensing base 219) to reduce the risk that the dispensing base will accidentally slip out of a person's grasp.

The dispensing base 219 may comprise a finger guard 279 positioned between the hand grip 275 and the first opening 227 of the body 211 when the dispensing base is attached to the body to discourage workers from gripping the dispensing base too close to the first opening and thereby being exposed to unnecessarily high radiation. As best shown in FIG. 9, for example, the finger guard 279 may comprise an annular flange 293 extending at least in part transversely outward of the hand grip 275 surface. The outer diameter of the finger guard 279 may be sized to make it more convenient to grip the dispensing base 219 by the hand grip 275 than at the finger guard or any location between the finger guard and the first opening 227. The distance between the finger guard 279 and the first opening 227 can be increased as needed to provide a desired level of protection against exposure of workers' hands to radiation escaping through the first opening. The finger guard 279 may also comprise one or more radiation-shielding materials to shield the hand of a person handling the dispensing shield 205 from radiation escaping through the first opening 227. Further, the finger guard 279 may be constructed of a material that is substantially impervious to penetration by a needle to protect a worker from accidental injury while inserting a needle into the dispensing shield.

Figure 11:
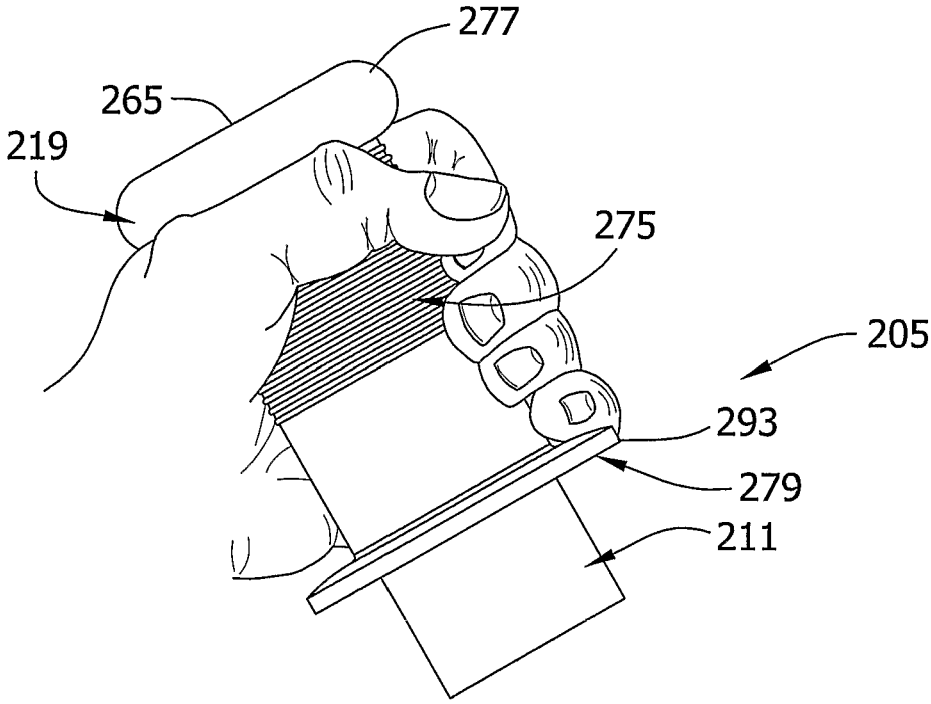
FIG. 11 is a perspective view of a person gripping the dispensing shield shown in FIG. 8 by a hand grip of the shield during a dispensing process.
Figure 11:
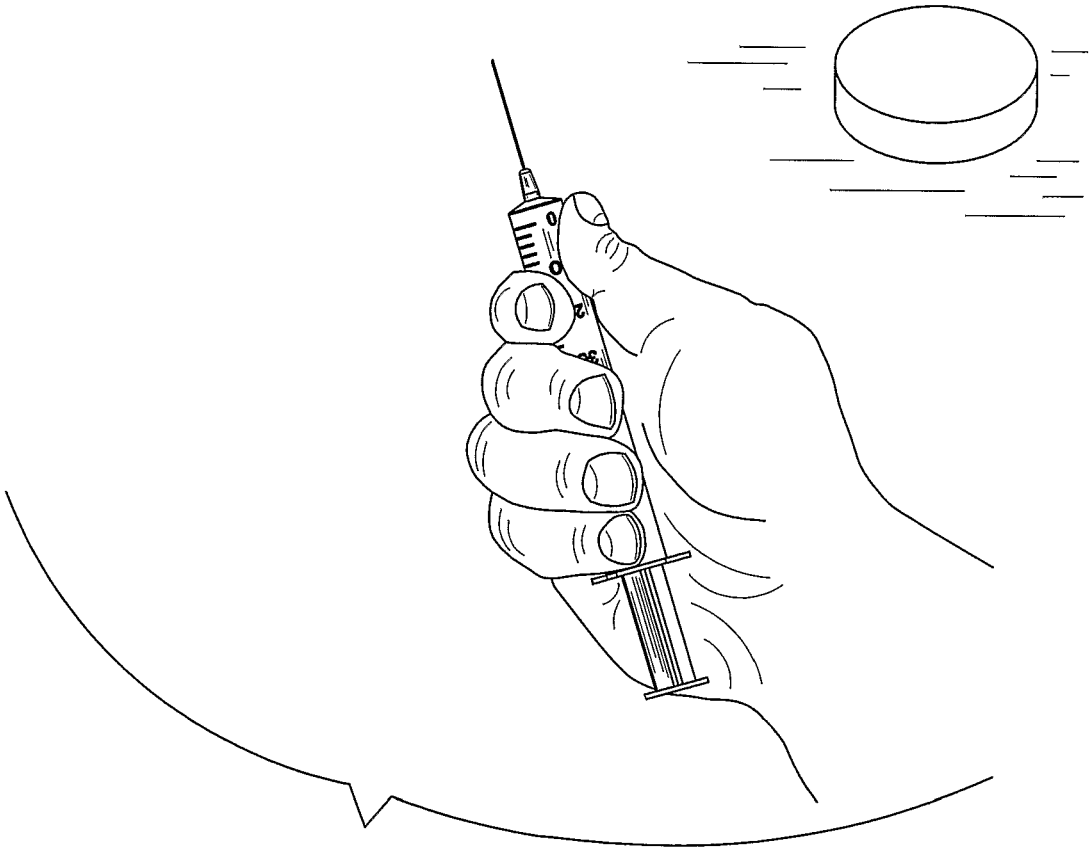
Figure 12A:
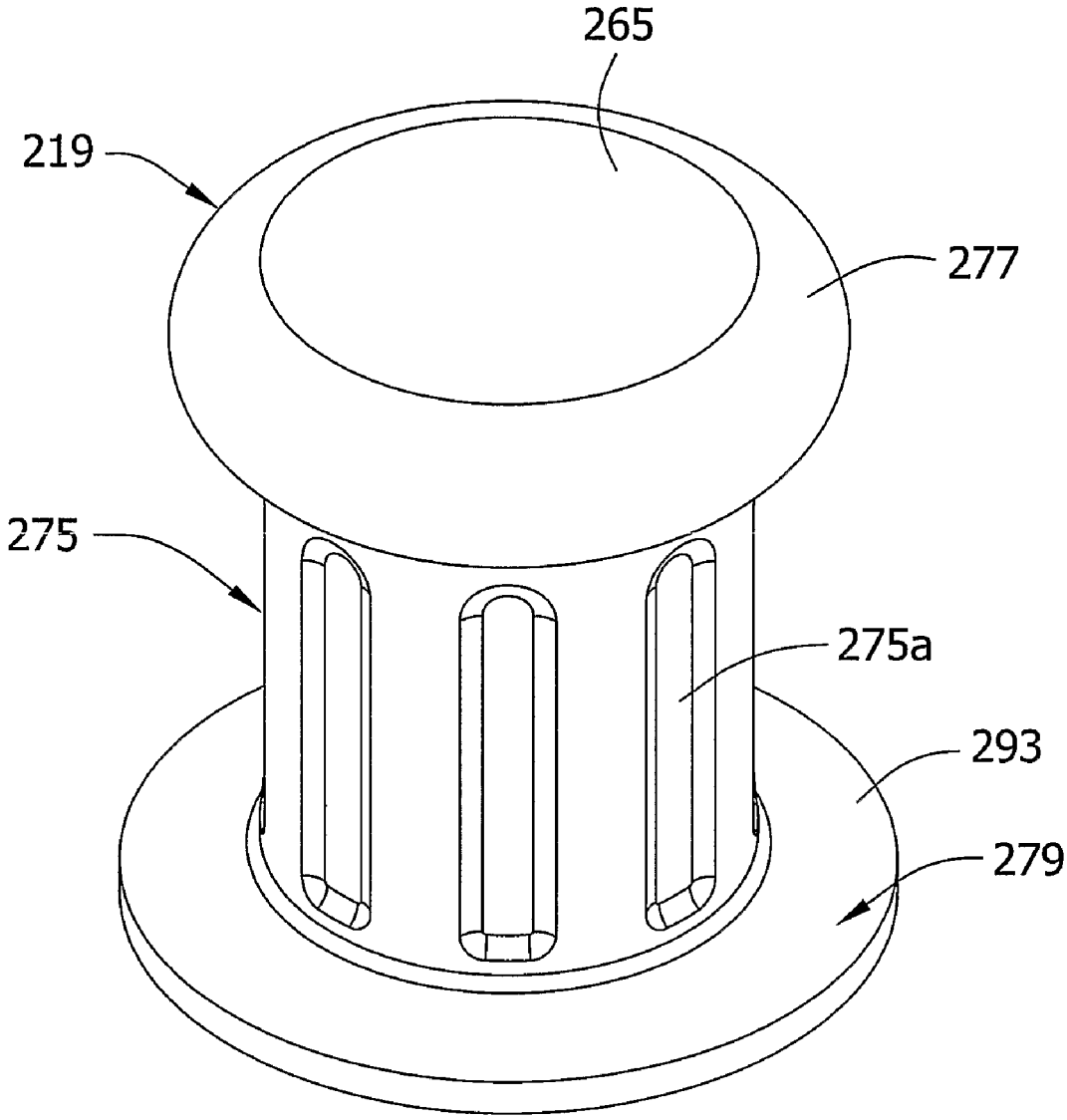
FIGS. 12A-12E show a variety of dispensing bases similar to the dispensing shield of the system shown in FIG. 7, each having a different grip enhancement construction.
Figure 12B:
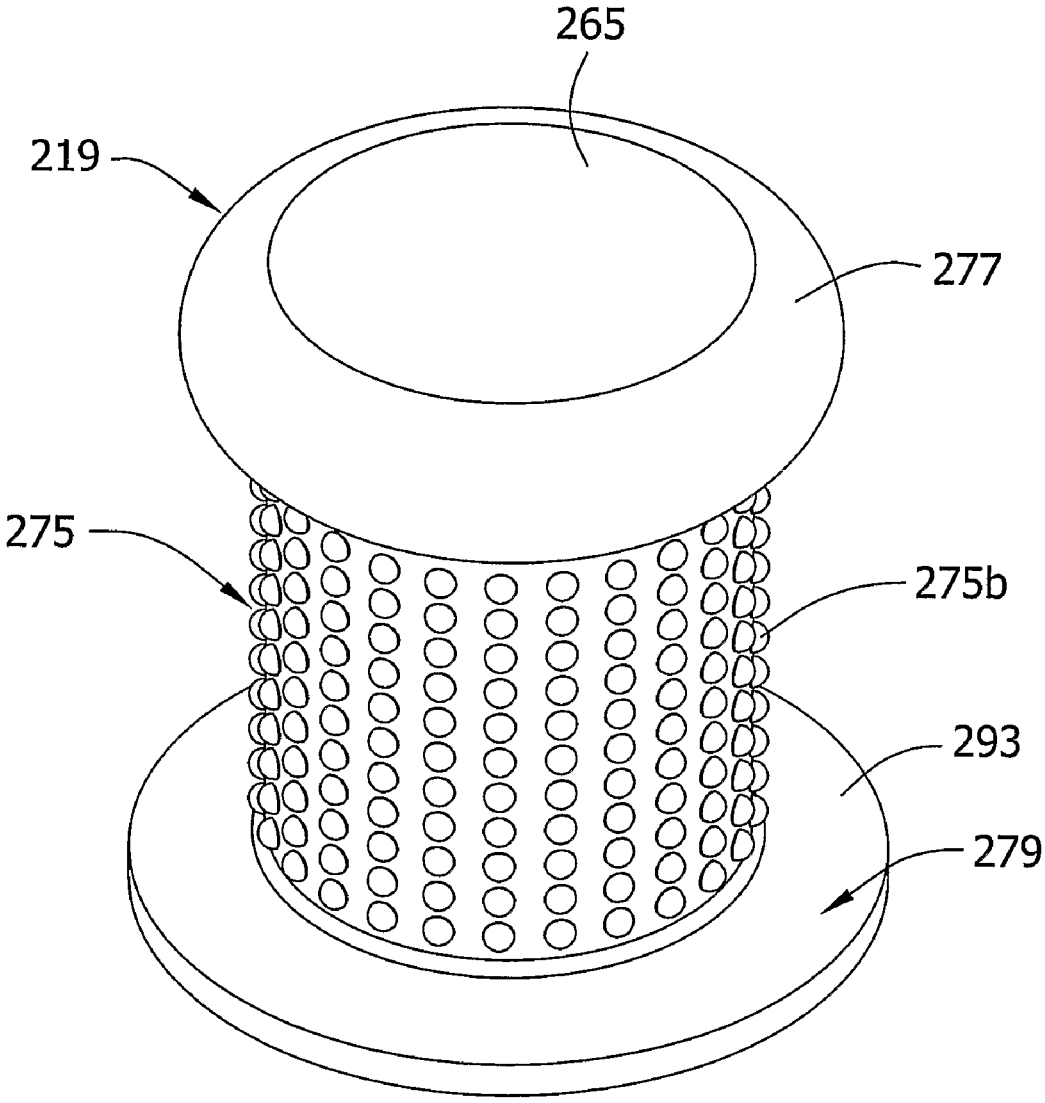
Figure 12C:
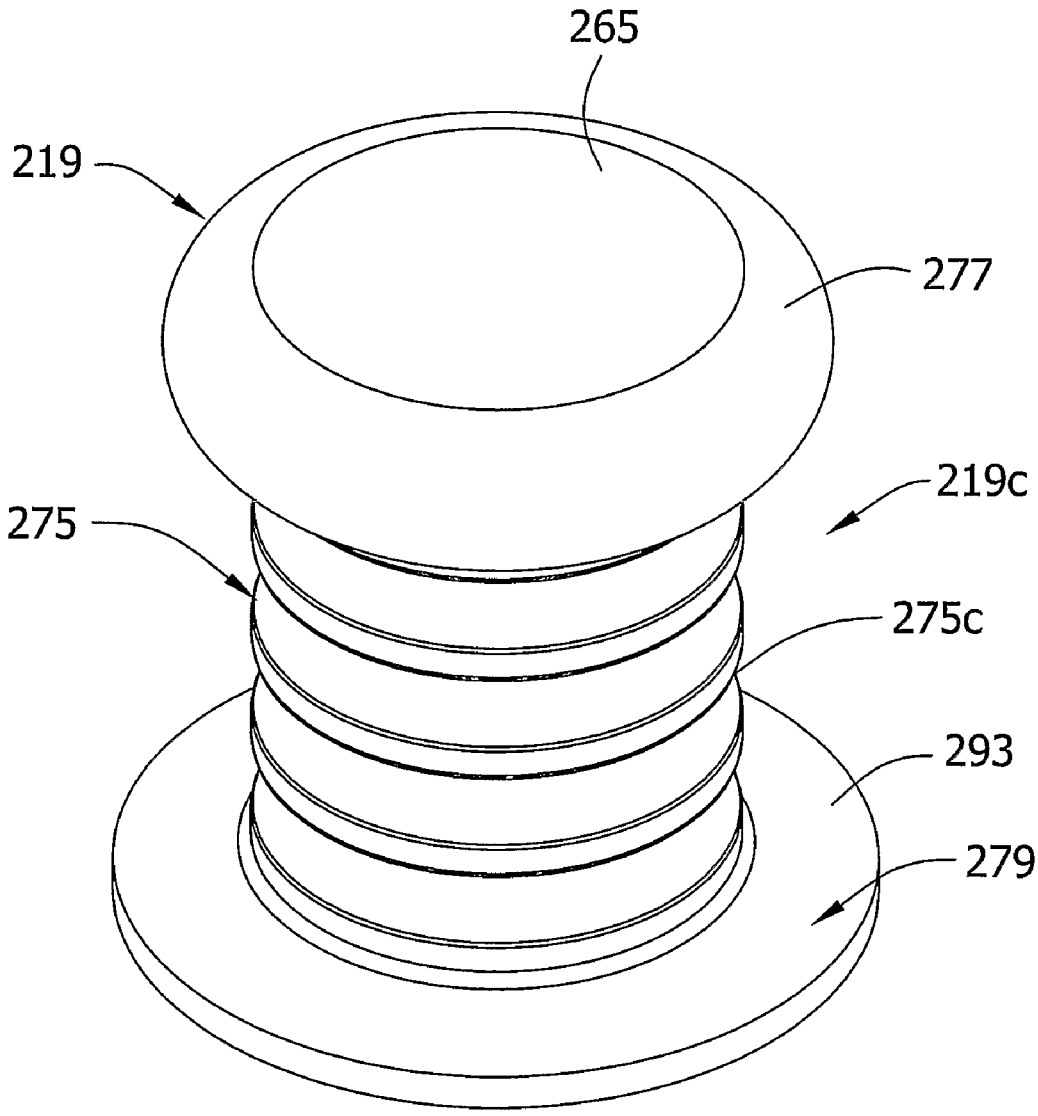
Figure 12D:
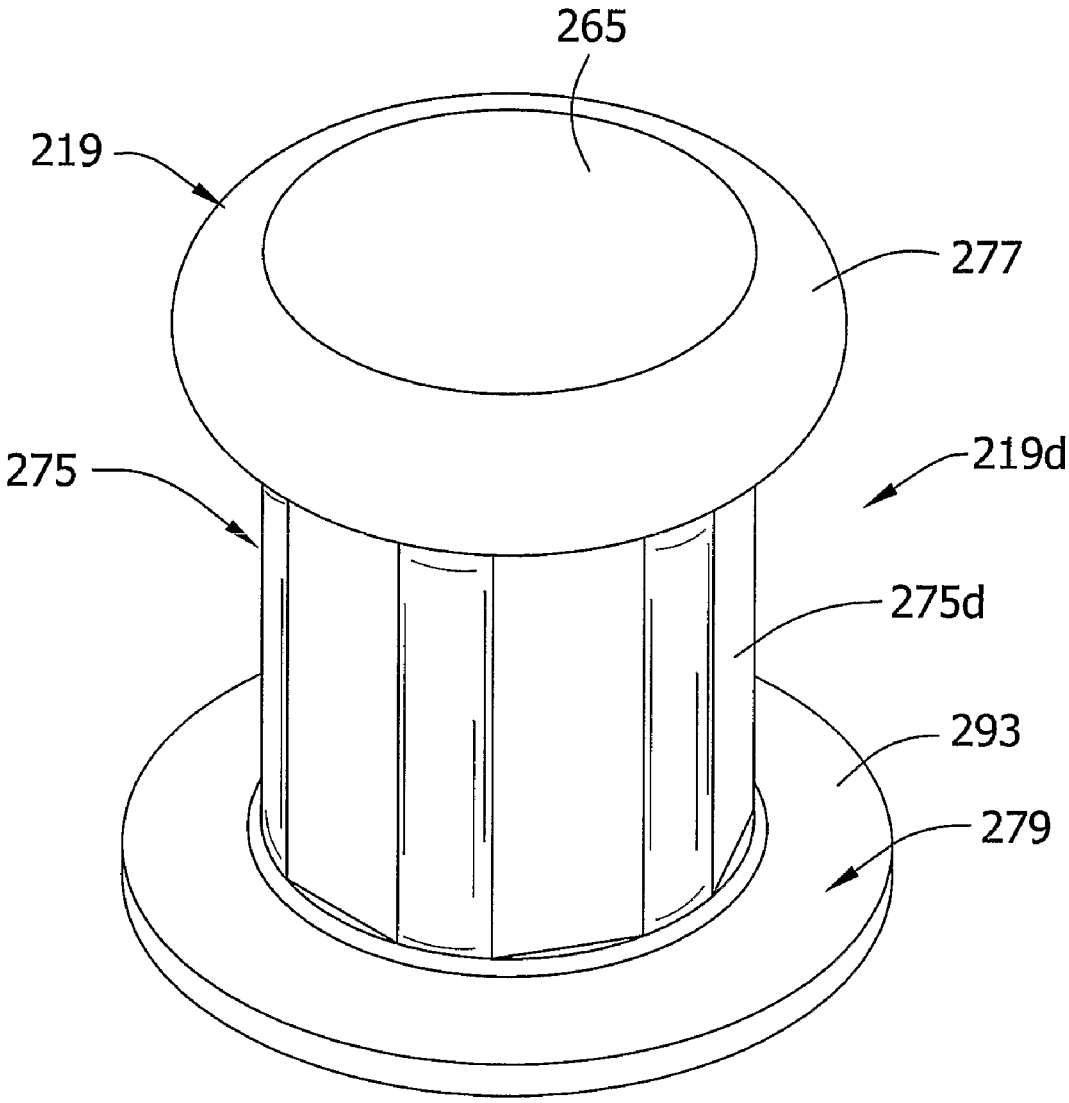
Figure 12E:
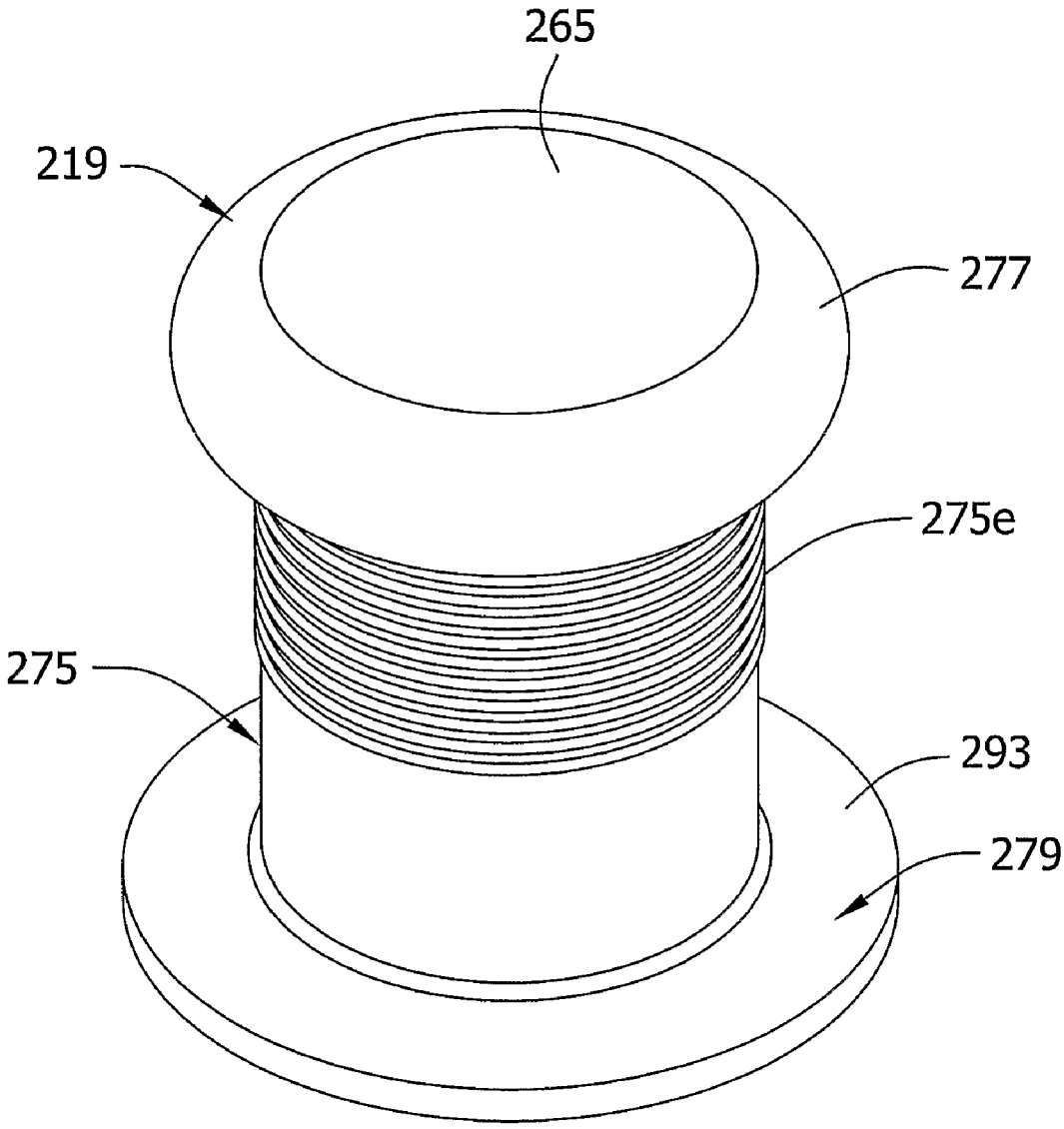

Although FIG. 11 illustrates a user gripping the dispensing base 219 by wrapping a hand at least partially around the circumference of the base, it is further contemplated that the benefits of the finger guard 279 also inure to a user who grips the dispensing base by its closed end 265 (e.g. by wrapping a hand at least partially over the end of the base 219 so the knob 277 is in the palm of the hand or by wrapping a hand at least partially around the circumference of the knob). Further, it may be desirable in some cases for a user grip the dispensing base 219 by the closed end 265 thereof (e.g., by the knob 277). For example, this may be a desirable practice from the standpoint of increasing the distance between the user's hand and the first opening 227 (e.g., to further reduce exposure of the user's hand to radiation). If that is the case, it is contemplated that the finger guard may be moved closer to the closed end of the dispensing base (and therefore farther from the first opening). For example, the finger guard may be closer to the end of the dispensing base than it is to the first opening 227. Moreover, if desired, the distance between the finger guard and the closed end of the dispensing base may be short enough (e.g., so that the finger guard is adjacent the closed end) that there is insufficient space between the finger guard and the closed end of the dispensing base for a user to wrap a hand around the side of the dispensing base between the finger guard and the end of the base to thereby encourage a user to grip the dispensing base at the closed end thereof.

The operation of the radiation-shielding system 201 is similar in many ways to the operation of the radiation system 101 described above. A container C1 (e.g., an evacuated elution vial) may be loaded into the cavity 213 through the second opening 229. Then the loading base 217 may be releasably attached to the body 211 to enclose the container C1 within the elution shield 203. If present at this time, the cap 215 may be removed from the body 211 to permit the container C1 to be connected to a radioisotope generator through the now exposed first opening 227, as described above. When a desired amount of radioactive eluate has been loaded into the container C1, the container may be disconnected from the radioisotope generator. The cap 215 may be replaced over the first opening 227 to limit escape of radiation through the first opening while the container C1 is carried to a location where the eluate can be analyzed.

The loading base 217 may be detached from the body 211 and the container C1 removed from the cavity 213 through the second opening 229 to analyze the eluate (e.g., in a calibration system). When the analysis of the eluate is complete, the container C1 may be replaced in the cavity 213 through the second opening 229. The dispensing base 219 may be releasably attached to the body 211 to enclose the container C1 in the dispensing shield 205. The cap 215 may be removed to permit initial access to the first opening 227 for the dispensing process. Thereafter, the body 211 may be placed upside down on a work surface (e.g., a radiation-shielding coaster 197 operable to limit escape of radiation through the first opening 227) until it is time to dispense some or all of the remaining eluate to another container (e.g., syringe).

A worker (e.g., a radiopharmacist) may grab the dispensing shield 205 by the hand grip 275 of the dispensing base 219 with one hand and lift the body 211 off the work surface 197 to access the container C1 through the first opening 227. For example, the tip of a needle attached to a syringe may be inserted into the cavity 213 through the first opening 227 to pierce the septum of the container C1 and draw eluate out of the container into the syringe. If the worker accidentally misses the first opening 227, the guard 279 may deflect the needle away from the hand that is holding the dispensing shield 205, thereby protecting the worker from injury. The ergonomic hand grip 275 makes it easy to hold the dispensing shield 205. Some people may prefer to grab the dispensing base 217 by palming the knob 277 in their hand. Others may prefer to wrap their fingers around the hand grip 275, in which case any grip enhancements 275*a*, 275*b*, 275*c*, 275*d*, 275*e* of the grip can make their grip more secure. The finger guard 279 discourages people from placing their hands too close to the first opening 227 when lifting the body 211 off the work surface 197, thereby preventing unnecessary exposure to radiation escaping through the first opening 227. Further, in embodiments of the system 201 in which the finger guard 279 comprises radiation-absorbing materials, the finger guard may shield the person's hand from a portion of the radiation escaping through the first opening 227, thereby further reducing exposure to radiation. When a desired amount of the eluate has been transferred from the container C1 in the dispensing shield 205 to another container, the person may replace the body 211 upside down on the work surface 197 until it is time to transfer eluate to another at which time the dispensing process may be repeated.

When the container C1 is empty or its contents are no longer desired, the dispensing base 219 may be detached from the body 211 and the container taken out of the cavity 213 through the second opening 229. Then the entire process may be repeated with another container.

Although various assembly components of the radiation-shielding system described above have generally cylindrical shapes, the geometric shapes of one or more of the various components may be varied without departing from the scope of the invention. Furthermore, if desired, a loading base could be designed to provide more than two options for varying the amount of space in the cavity for greater flexibility in adapting the system for use with various different sized containers without departing from the scope of the invention.

In view of the above, it will be seen that the several objects of the invention are achieved and other advantageous results attained.

When introducing elements of the present invention or various embodiments thereof, the articles "a", "an", "the", and "said" are intended to mean that there are one or more of the elements. The terms "comprising", "including", and "having" are intended to be inclusive and mean that there may be additional elements other than the listed elements. Moreover, the use of "top" and "bottom" and variations of these terms is made for convenience, but does not require any particular orientation of the components.

As various changes could be made in the above systems and methods without departing from the scope of the invention, it is intended that all matter contained in the above description and shown in the accompanying figures shall be interpreted as illustrative and not in a limiting sense.

The invention claimed is:

1. A radiation-shielding assembly for radioactive material, the assembly comprising:

a body having a cavity defined therein for receiving radioactive material, the body having first and second openings into the cavity, the first opening being sized smaller than the second opening, and the body being constructed to limit escape of radiation from the cavity through the body;

a first base releasably attachable to the body generally at the second opening thereof; and a second base releasably attachable to the body generally at the second opening thereof when the first base is not releasably attached to the body, wherein the first base has a length and a weight, and wherein the second base has at least one of a shorter length and a lighter weight than the first base;

the first base including first and second closure surfaces, wherein the first base is releasably attachable to the body in a first orientation in which the first closure surface is positioned generally at the second opening and faces inward of the cavity at a first distance from the first opening, and wherein the first base is releasably attachable to the body in a second orientation in which the second closure surface is positioned generally at the second opening and faces inward of the cavity at a second distance from the first opening, the first distance being different from the second distance.

2. The assembly of claim 1, wherein the body and first base together have a first center of gravity when the first base is releasably attached to the body, wherein the body and second base together have a second center of gravity when the second base is releasably attached to the body, and wherein the first center of gravity is closer to the first opening than the second center of gravity.

3. The assembly of claim 1, wherein the first base comprises:

a radiation shield adapted to limit passage of radiation therethrough and positioned generally at the second opening when the first base is releasably attached to the body; and an extension element connected to the radiation shield and configured to extend away from the body when the first base is attached thereto.

4. The assembly of claim 3, wherein the extension element is constructed of a material that is substantially transparent to radiation.

5. The assembly of claim 1, wherein the first base comprises an extension element having first and second spaced apart ends, a first radiation shield connected to the first end of the extension element and adapted to limit escape of radiation from the cavity through the second opening when the first base is attached to the body in the first orientation, and a second radiation shield connected to the second end of the extension element and adapted to limit escape of radiation from the cavity through the second opening when the first base is connected to the body in the second orientation.

6. The assembly of claim 5, wherein the extension element is substantially transparent to radiation.

7. The assembly of claim 5, wherein the extension element and body are constructed of different materials, the material of the extension element being less dense than the material of the body.

8. The assembly of claim 1, wherein the second base comprises first and second closure surfaces, wherein the second base is releasably attachable to the body in a first orientation relative to the body in which the first closure surface is positioned generally at the second opening and faces inward of the cavity at a first distance from the first opening, and wherein the second base is releasably attachable to the body in a second orientation relative to the body in which the second closure surface is positioned generally at the second opening and faces inward of the cavity at a second distance from the first opening, the first distance being different from the second distance.

9. The assembly of claim 8, wherein the second base comprises a single radiation shield.

10. The assembly of claim 8, wherein the second base is constructed for threaded attachment to the body in the first and second orientations.

11. The assembly of claim 1, further comprising:

a cap constructed for releasable engagement with the body generally at the first opening thereof.

12. The assembly of claim 1, wherein at least one of the body, the first base, and the second base comprises tungsten-impregnated plastic.

13. The assembly of claim 1, wherein at least one of the first and second bases is constructed to limit escape of radiation from the cavity through the second opening of the body when the respective base is attached to the body.

14. The assembly of claim 1 in combination with the container of radioactive material.

15. A radiation-shielding assembly for radioactive material, the assembly comprising:

a body having a cavity defined therein for receiving radioactive material, the body having first and second openings into the cavity, the first opening being sized smaller than the second opening, and the body being constructed to limit escape of radiation from the cavity through the body;

a first base releasably attachable to the body generally at the second opening thereof; and a second base releasably attachable to the body generally at the second opening thereof when the first base is not releasably attached to the body, wherein the first base has a length and a weight, and wherein the second base has at least one of a shorter length and a lighter weight than the first base;

the second base including first and second closure surfaces, wherein the second base is releasably attachable to the body in a first orientation relative to the body in which the first closure surface is positioned generally at the second opening and faces inward of the cavity at a first distance from the first opening, and wherein the second base is releasably attachable to the body in a second orientation relative to the body in which the second closure surface is positioned generally at the second opening and faces inward of the cavity at a second distance from the first opening, the first distance being different from the second distance.

16. The assembly of claim 15, wherein the second base comprises a single radiation shield.

17. The assembly of claim 15, wherein the second base is constructed for threaded attachment to the body in the first and second orientations.

18. The assembly of claim 15, further comprising:

a cap constructed for releasable engagement with the body generally at the first opening thereof.

19. The assembly of claim 15, wherein at least one of the first and second bases is constructed to limit escape of radiation from the cavity through the second opening of the body when the respective base is attached to the body.

20. The assembly of claim 15 in combination with the container of radioactive material.

21. A radiation-shielding assembly for radioactive material, the assembly comprising:

a body having a cavity defined therein for receiving a first container of radioactive material, the body having first and second openings into the cavity, the first opening being sized smaller than the second opening, and the body being constructed to limit escape of radiation from the cavity through the body;

a first base releasably attachable to the body generally at the second opening thereof; and a second base releasably attachable to the body generally at the second opening thereof when the first base is not releasably attached to the body, wherein the first base has a length, and wherein the second base has a shorter length than the first base to accommodate a second container;

the body and first base together having a first center of gravity when the first base is releasably attached to the body, the body and second base together having a second center of gravity when the second base is releasably attached to the body, and wherein the first center of gravity is closer to the first opening than the second center of gravity.

22. The assembly of claim 21 in combination with the container of radioactive material.

* * * * *